US007466326B2

(12) United States Patent
Tokutake et al.

(10) Patent No.: US 7,466,326 B2
(45) Date of Patent: Dec. 16, 2008

(54) IMAGE FORMING METHOD AND IMAGE FORMING APPARATUS

(75) Inventors: Shigeaki Tokutake, Hachioji (JP); Masao Asano, Tokyo (JP); Hiroshi Yamazaki, Hachioji (JP); Yoshihiko Eto, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 474 days.

(21) Appl. No.: 11/235,578

(22) Filed: Sep. 26, 2005

(65) Prior Publication Data

US 2006/0164496 A1 Jul. 27, 2006

(30) Foreign Application Priority Data

Jan. 21, 2005 (JP) ..... 2005-013888

(51) Int. Cl.
*B41J 2/435* (2006.01)
*G03G 15/00* (2006.01)

(52) U.S. Cl. ..... 347/112

(58) Field of Classification Search ..... 347/112, 347/115, 119, 130, 139, 153
See application file for complete search history.

(56) References Cited

U.S. PATENT DOCUMENTS

2005/0037273 A1 * 2/2005 Shibata et al. ..... 430/59.6

FOREIGN PATENT DOCUMENTS

JP 08-328287 * 12/1996
JP 2000-47407 * 2/2000

* cited by examiner

*Primary Examiner*—Huan H Tran
(74) *Attorney, Agent, or Firm*—Lucas & Mercanti, LLP

(57) ABSTRACT

An image forming method, comprising the steps of: charging uniformly a surface of an organic photoreceptor while rotating the organic photoreceptor; exposing the charged surface of the photoreceptor with a light beam having a wavelength in the range of 350 nm to 500 nm in a main scanning direction to form a dot-shaped electrostatic latent image on the photoreceptor; and developing the dot-shaped electrostatic latent image with toner to form a dot-shaped toner image on the photoreceptor so as to satisfy the following formulas:

$1.1 \leqq B/A \leqq 1.5$ and $10 \leqq A \leqq 50$, where A is the length (μm) of an exposed dot of the dot-shaped electrostatic latent image in the main scanning direction, and B is the length (μm) of a toner dot of the dot-shaped toner image in the main scanning direction.

20 Claims, 5 Drawing Sheets

IMAGE FORMING METHOD AND IMAGE FORMING APPARATUS

BACKGROUND

Field of the Invention

The present invention relates to image forming methods and image forming apparatuses used for image forming in the electrophotographic method, and more particularly to image forming methods and image forming apparatuses used for image forming in the electrophotographic method used in the field of copying machines or printers.

In recent years, in the fields of printing and color printing, there are increasing opportunities for using copiers of printers of the electro-photographic method. In this printing field or in the field of color printing, there is a strong trend of demanding high picture quality digital monochrome or color images. In response to such demand, it has been proposed to carry out high-resolution digital images using a short wavelength laser light as the exposure light source (Patent Document 1). However, even if a short wavelength laser light is used and the exposure dot diameter is reduced and fine electrostatic latent image is formed on the electro-photographic photosensitive material, at present, the finally obtained electro-photographic image has not reached sufficient high image quality.

One of the reasons for this is that, even if a fine diameter dot latent image is formed on the electro-photographic photosensitive material, using a short wavelength laser light, it is not possible to reproduce accurately that dot latent image as a toner image. In other words, the surface characteristics of the electro-photographic photosensitive material is poor in uniformity in micrometer units, the dot latent image formed by a short wavelength laser gets reproduced as a toner image that is smaller in size than the latent image, or as a toner image that is larger in size than the latent image, and it is not possible to form a toner image that is uniform on a micrometer scale.

Further, although organic photoreceptor having photosensitive characteristics to short wavelength lasers have been developed as the electro-photographic photoreceptor (Patent Document 1), such organic photoreceptor do not have uniform surface characteristics on a micrometer scale described above, and it is necessary to develop organic photoreceptor having surface characteristics that can permit the formation of uniform toner images from latent images of micrometer size of 10 to 50 μm formed by short wavelength lasers.

As a method of improving the surface characteristics of organic photoreceptor, an organic photosensitive material has been proposed (Patent Document 2) which includes fine particles of fluorocarbon resins in the surface of the organic photoreceptor. Although such organic photoreceptor having fine particles of fluorocarbon resins prevent toner filming, etc., and have the characteristics of the surface being difficult to get contaminated, but in the micrometer size level the surface uniformity is insufficient, and it is not possible to form uniform toner images from latent images of micrometer size of 10 to 50 μm formed by short wavelength lasers.

Patent Document 1: Japanese Unexamined Patent Application Laid Open No. 2000-47407

Patent Document 2: Japanese Unexamined Patent Application Laid Open No. Hei 8-328287

SUMMARY

The present invention was made to solve the above problems. An object of the present invention is to provide an image forming method and an image forming apparatus in which it is possible to form with very fine detail an electrostatic latent image formed on an organic photoreceptor using an image exposure light source of a semiconductor laser or a light emitting diode with an oscillation wavelength of 350 to 500 nm, and to reproduce that very fine detail electrostatic latent image faithfully as a toner image, and also to provide an image forming method and an image forming apparatus that can form high image quality color images.

Further, an object of the present invention is, in an image forming method using a semiconductor laser or a light emitting diode with an oscillation wavelength of 350 to 500 nm as the writing light source and having an exposing device that forms on an organic photoreceptor very fine detail electrostatic latent image with an exposure dot diameter of 10 to 50 μm in the main scanning direction of the writing light source, to provide an image forming method and an image forming apparatus that combines and organic photoreceptor and a developer that permits the reproduction of faithful toner image from said electrostatic latent image.

DETAILED DESCRIPTION OF THE PREFERRED EMBODIMENT

Figure 1:
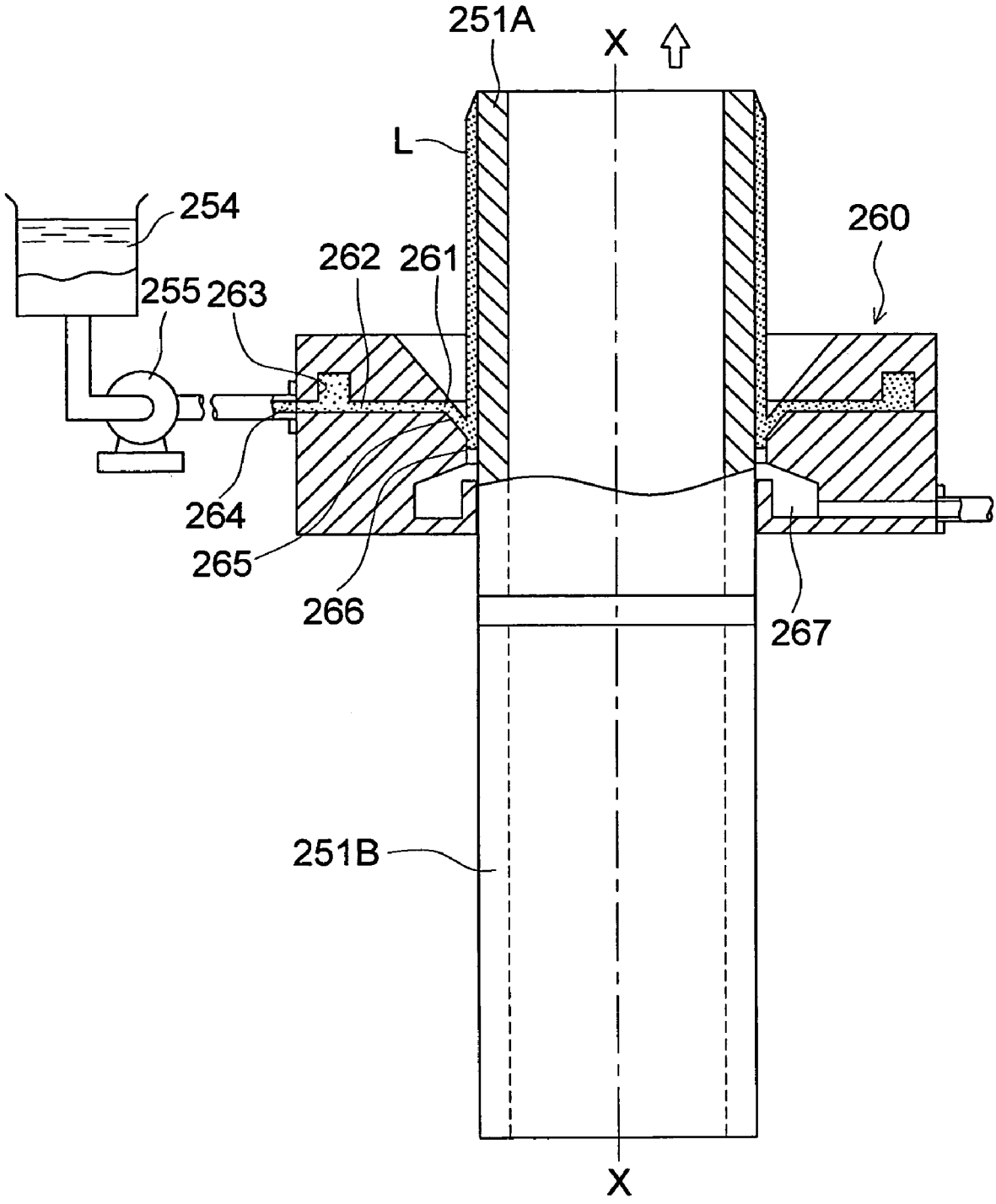
FIG. 1 is a sectional view of an example of a circular slide hopper type coating apparatus relating to the invention.

After making several investigations about the above problem, because a subject of the present invention is to form high-resolution electrostatic latent image on an organic photoreceptor using an image forming light sources of a semiconductor laser or a light emitting diode with an oscillation wavelength of 350 to 500 nm, and also to reproduce that high-resolution electrostatic latent image as a faithful toner image, we completed the present invention after finding out that it is possible to carry out high-resolution toner image formation compatible with high density electrostatic latent images, by forming, using a short wavelength laser light, an electrostatic latent image with excellent dot reproduction characteristics on the organic photoreceptor (the dot latent image should be formed sharply with good hemline endings) and at the same time, by making the surface characteristics of the organic photoreceptor uniform on a micrometer scale.

The present invention is described in detail in the following.

Firstly, a preferred embodiment according to the invention is explained.

In an image forming method of uniformly charging the surface of an organic photoreceptor using a charging device, forming an electrostatic latent image using an exposing device having a semiconductor laser or light emitting diode with an oscillation wavelength in the range of 350 to 500 nm as the writing light source, and then visualizing the electrostatic latent image so formed into a toner image using a developing device, if the exposing light dot diameter is taken as A (μm) in the main scanning direction of said writing light source, and the dot diameter as B (μm) of the developed image in the main scanning direction formed on the organic photoreceptor corresponding to said A, the feature of the image forming method is that the relationship between A and B above is the following.

Here, when the electrostatic latent image and the toner image are formed while rotating the organic photoreceptor, the main scanning direction is a direction substantially perpendicular to the rotating direction of the photoreceptor.

$$1.1 \leqq B/A \leqq 1.5 \text{ (herein, } 10 \leqq A \leqq 50)$$

Further, in an image forming method of uniformly charging the surface of an organic photoreceptor using a charging device, forming an electrostatic latent image using an exposing device having a semiconductor laser or light emitting diode with an oscillation wavelength in the range of 350 to 500 nm as the writing light source, and then visualizing the electrostatic latent image so formed into an explicit toner image using a developing device, if it is taken that the contact angle of the surface layer of said organic photoreceptor with water is 90° or more and the variations in the contact angle are not more than ±2.0°, and if the exposing light dot diameter is taken as A (μm) in the main scanning direction of said writing light source, and the dot diameter as B (μm) of the developed image in the main scanning direction formed on the organic photoreceptor corresponding to said A, the image forming method has the feature that the relationship between A and B above is the following:

$$1.1 \leqq B/A \leqq 1.5 \text{ (herein, } 10 \leqq A \leqq 50)$$

Further, in an image forming method that provides for a plurality of developing device with different colored pigments to be present in the neighborhood of the organic photoreceptor, and which image forming method comprises: uniformly charging the surface of the organic photoreceptor using a charging device, forming an electrostatic latent image using an exposing device having a semiconductor laser or light emitting diode with an oscillation wavelength in the range of 350 to 500 nm as the writing light source, then forming a toner image on the organic photoreceptor using a developing device corresponding to the color information of the electrostatic latent image, and then transferring each of the color toner images superimposing one after the other and thereby forming a color toner image on an intermediate image transfer body, and finally a step of forming a color image by transferring that color toner image in one operation from the intermediate image transfer body onto a transfer material, if it is taken that the contact angle of the surface layer of said organic photoreceptor with water is 90° or more and the variations in the contact angle are not more than ±2.0°, and if the exposing light dot diameter is taken as A (μm) in the main scanning direction of said writing light source, and the dot diameter as B (μm) of the developed image in the main scanning direction formed on the organic photoreceptor corresponding to said A, the image forming method has the feature that the relationship between A and B above is the following:

$$1.1 \leqq B/A \leqq 1.5 \text{ (herein, } 10 \leqq A \leqq 50)$$

Further, in an image forming method of providing in parallel a plurality of image forming units, with each image forming unit comprising at least an organic photoreceptor, a charging device which uniformly charges the surface of the organic photoreceptor, an exposing device which forms an electrostatic latent image and having a semiconductor laser or light emitting diode with an oscillation wavelength in the range of 350 to 500 nm as the writing light source, a developing device which then forms a toner image on the organic photoreceptor corresponding to the electrostatic latent image, a transfer device which transfers said toner image to an intermediate image transfer body, and transferring each of the color toner images superimposing one after the other and thereby forming a color toner image on an intermediate image transfer body, and finally forming a color image by transferring that color toner image in one operation from the intermediate image transfer body onto a transfer material, if it is taken that the contact angle of the surface layer of said organic photoreceptor with water is 90° or more and the variations in the contact angle are not more than ±2.0°, and if the exposing light dot diameter is taken as A (μm) in the main scanning direction of said writing light source, and the dot diameter as B (μm) of the developed image in the main scanning direction formed on the organic photoreceptor corresponding to said A, the image forming method has the feature that the relationship between A and B above is the following:

$$1.1 \leqq B/A \leqq 1.5 \text{ (herein, } 10 \leqq A \leqq 50)$$

In an image forming method using a short wavelength laser, because of having the above configuration, the image forming method makes it possible to form high-density dot images, and also to form high image quality electro-photographic latent images without toner splashing. In addition, even in the production of color images, the fine line reproduction is very good and it is possible to prepare color images with excellent color reproduction.

The configuration of the image forming method is described in the following.

By having the above structure, the image forming method of forming an electrostatic latent image using as the writing light source a semiconductor laser or a light emitting diode oscillation in a wavelength range of 350 to 500 nm, it is possible to reproduce the very fine electrostatic latent image formed on the organic photoreceptor as a very fine toner image, and it is possible to form good electro-photographic images having satisfactory dot reproducibility and also with good sharpness and color reproduction.

Hereafter, a structure of an organic photoreceptor according to the present invention is explained.

The organic photoreceptor preferably has a contact angle of 90° or more for water the surface layer of the organic photoreceptor and a dispersion of ±2.0 in the contact angle. The surface layer which has such characteristics can be produced by making a surface layer include the specific fluorine-containing resin particles.

It is possible to manufacture a stable dispersions by controlling mutual cohesiveness of the fluorine-containing resin particles, when dispersing dispersions of fluorine-containing resin particles whose number average primary particle size is not less than 0.02 μm and is less than 0.20 μm and crystallinity less than 90% by employing low-boiling point solvent having excellent dispersibility, preferably by employing an organic solvent having a boiling point of 120° C. or less under the pressure of the atmosphere (for example, THF, ethanol, toluene, dichloroethane or the like). At the same time, it is possible to form the surface layer wherein dispersibility of the fluorine-containing resin particles is excellent by preventing aggregation of the fluorine-containing resin particles in the surface layer and interfacial peeling between a fluorine-containing resin particle and binder resin, when forming a surface layer by using a coating apparatus of a coating solution supplying type and drying it. As a result, it is possible to form an organic photoreceptor having a surface layer on which fluctuation of contact angles is small and surface energy is uniform, and thereby, to manufacture an organic photoreceptor wherein generation of dielectric breakdown and black spots, or dash mark and blurred images can be prevented, and electrophotographic images in which sharpness of halftone images is excellent can be formed.

The coating apparatus of a coating solution supplying type mentioned above device a coating apparatus to coat by supplying a coating solution needed for layer formation onto a conductive support, and an example thereof includes a slide hopper type coating apparatus, an extrusion type coating apparatus and a spray coating apparatus. Compared with dipping coating to coat by dipping a conductive support in a coating solution, the coating apparatus of a coating solution supplying type has advantages that dispersions are not stagnated in the coating apparatus, a surface layer is formed on a one-way basis, and thereby, dispersed particles of the fluorine-containing resin particles are free from repeated aggregation shearing in dispersions, and a uniform surface layer having less aggregation of the fluorine-containing resin particles can be formed. In addition, aging aggregation of dispersions can be prevented because dispersions can be prepared for each manufacture of a photoreceptor, and coating can be carried out without dissolving an underlayer which has already been formed on the conductive support in the course of forming a surface layer, which makes it possible to form a surface layer having uniform dispersions in which aggregation of the fluorine-containing resin particles is less even in the case of coating and drying.

Among the aforesaid coating solution supplying type coating apparatuses, a coating method employing a slide hopper type coating apparatus is most suitable for the occasion to use dispersions in which the low-boiling point solvent is used, as a coating solution, and in the case of a cylindrical photoreceptor, it is preferable to coat by using a circular slide hopper type coating apparatus described fully in TOKKAISHO No. 58-189061.

The following gives a brief description of the circular quantity-regulated coating machine.

Figure 2:
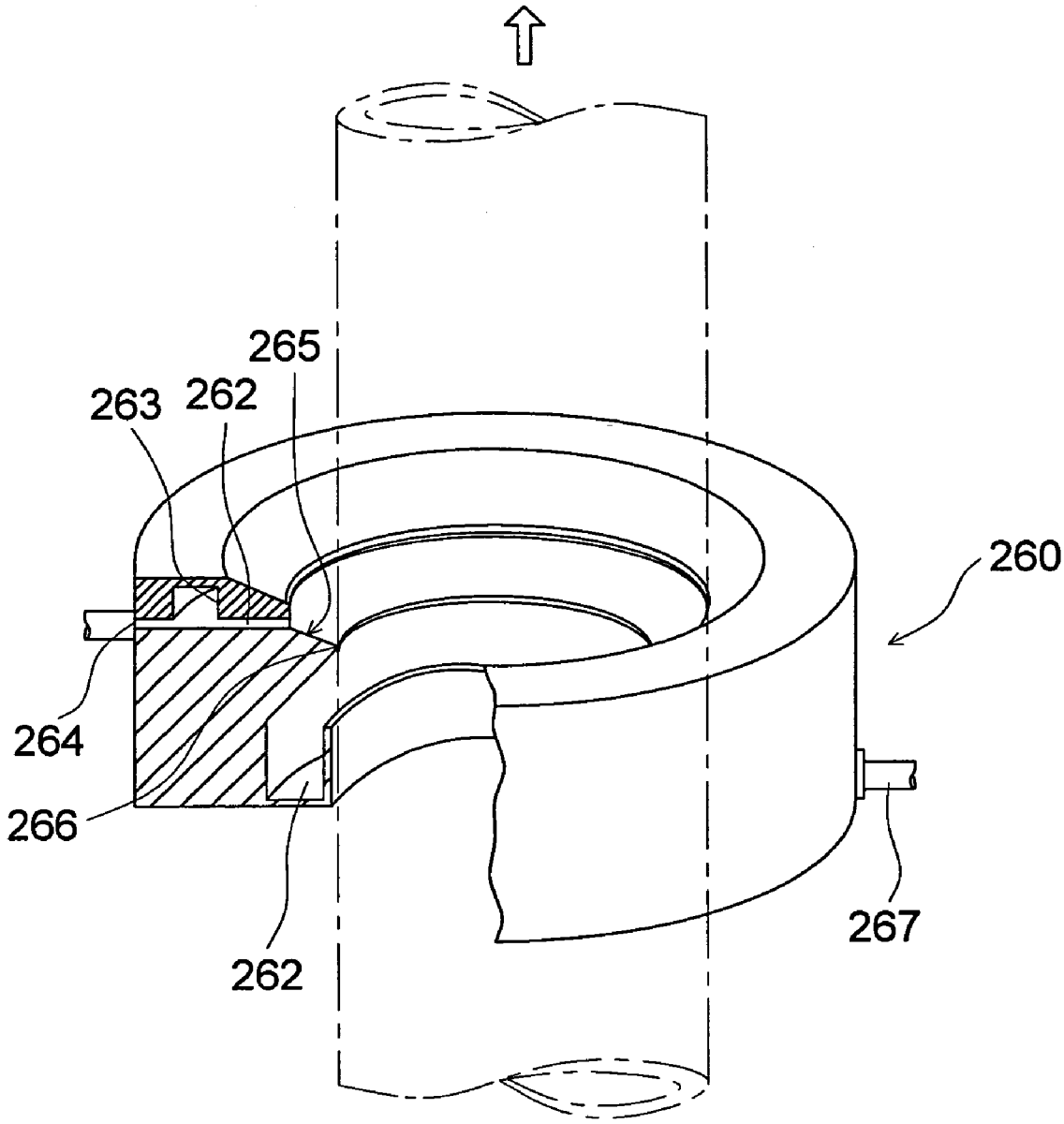
FIG. 2 is a perspective view of an example of a circular slide hopper type coating apparatus relating to the invention.

In the invention, a coating solution wherein fluorine-containing fine particles are dispersed is coated in a profitable way by using a circular slide hopper type coating apparatus. In an example of the circular slide hopper type coating apparatus, cylindrical base materials 251A and 251B connected vertically along center line XX are lifted continuously in the direction of an arrow as shown on a longitudinal sectional view in FIG. 1, for example, portion (which is simply called a coating head) 260 that is directly related to coating of the slide hopper type coating apparatus that surrounds the base material coats coating solution L on an outer circumferential surface of the base material 251. Incidentally, the base material may also be a base material of a seamless belt type, in addition to a hollow drum such as an aluminum drum and a plastic drum. As shown in FIG. 2, on the coating head 260, there is formed narrow coating solution distributing slit (which is called a slit simply) having coating solution outlet 261 that is opened to the base material 251 side, in the horizontal direction. The slit 262 is communicated with annular coating solution distributing chamber 263, and coating solution L in reservoir tank 254 is supplied to this annular coating solution distributing chamber 263 through supply tube 264 by pressure pump 255. On the other hand, on the lower side of the coating solution outlet 261 of the slit 262, there is formed slide surface 265 which is inclined downward continuously and is formed to be a terminal end whose dimension is slightly greater than the outer dimension of the base material. Further, there is formed lip portion (bead: solution pool) 266 that extends downward from the terminal end of the slide surface 265. In coating conducted by the coating apparatus of this kind, coating solution L is extruded from the slit 262 in the course of lifting the base material 251, when the coating solution flows down along the slide surface 265, a photosensitive solution which has arrived at the terminal end of the slide surface forms a bead between the terminal end of the slide surface and an outer circumferential surface of the base material 251, and then, is coated on the surface of the base material. Excessive photosensitive solutions are ejected from ejection section 267.

The circular slide hopper type coating apparatus makes coating solution to flow down along slide surface 265, and a coating solution arriving at a terminal end of the slide surface 265 forms a bead between the terminal end of the slide surface 265 and cylindrical base material 251A, thus, a coated film is formed on the cylindrical base material.

In the coating method employing the circular slide hopper type coating apparatus, the terminal end of the slide surface and a base material are arranged with a gap (approx. 2 μm-2 mm) between them, therefore, the base material is not damaged, and even when many layers each being different from others in terms of characteristic are formed, coating can be carried out without damaging the layer which has been coated already. Further, even when forming layers each being different from others in terms of characteristics and being dissolved in the same solvent, on a multi-layer basis, components in the lower layer hardly elute to the upper layer side because of the period of time of existence in the solvent is shorter than that in a dipping coating method, and coating can be carried out without deteriorating dispersibility of fluorine-containing resin particles because coating can be conducted without eluting in a coating tank.

The fluorine-containing resin particles have a number average primary particle diameter from 0.02 μm inclusive to 0.20 μm exclusive. If the number average primary particle diameter is less than 0.02 μm, the stability of the dispersion solution may deteriorate and coagulation among the fluorine-containing resin particles may occur. This will make uniform dispersion difficult and will cause increased variations in the contact angle, with the result that the generation of dielectric breakdown and black spots, or dash mark and blurred images are easily occurred. If the number average primary particle diameter is greater than 0.20 μm, coagulated particles may be easily produced by flocculation, and variations in the contact angle of the layer containing the fluorine-containing resin particles may be increased. Thus, generation of dielectric breakdown and black spots, or dash mark and blurred images may be more likely to occur, and at the same time, the image exposure of laser beam or the like may scatter and the sharpness of the image may deteriorate. The number average primary particle diameter of the fluorine-containing resin particles not less than 0.02 μm and not more that to 0.18 μm may be more preferable.

In this specification, the average primary particle diameter can be measured from a photograph taken from a sectional layer of a photoreceptor with a transmission type electron microscope. As the transmission type electron microscope, a device type well known among ordinary persons, such as LEM-2000 type (by Topcon Co., Ltd.), JEM-2000FX (by Japan electronic Co,. Ltd.) may be used. More concretely, firstly, a thin piece shaped sample is cut out from a photoreceptor by the use of Microtome equipped with a diamond knife and the sectional layer condition of it is photographed with a 10000 time magnification. The number of fine particles conducted for TEM photography is at least 100 pieces or more.

When the contact angle of the surface layer with respect to water is less than 90°, the toner contains a greater amount of deposits of the inorganic external additives such as silica, and the generation of dielectric breakdown and black spots, or dash mark and blurred images tend to occur. Further, there will be an increase in frictional drag with the contact member of the photoreceptor such as a cleaning blade, and the amount of wear will be increased by fretting, so that streak-like irregularities of the image will occur and sharpness of the image will deteriorate more easily. The more preferred contact angle is 95° or more without exceeding 120°. If the contact angle has exceeded 120°, the amount of fine particles of fluorine-containing resin in the surface layer becomes excessive and the surface layer becomes soft. Fretting tends to occur, with the result that a blurred image will occur easily. In the meantime, if the variation of contact angle is out of the range ±2.0°, the dispersion property of the fine particles of fluorine-containing resin on the surface layer will be uneven, and inorganic components in the toner or paper powder, for example, inorganic external additives such as silica and titanium oxide in the toner, or the talc component will be embedded into the surface layer, with the result that the generation of dielectric breakdown and black spots, or dash mark and blurred images tend to be produced. Black and white streaks also tend to be produced. The variation in the contact angle is more preferred to be within ±1.7°.

Measurement of Contact Angle and its Variation

The contact angle in the sense is defined as the contact angle to the surface of a photoreceptor with respect to pure water (at 20° C.). The contact angle of the photoreceptor is obtained by measuring the contact angle with respect to pure water using a contact angle meter (Model CA-DT.A by Kyowa Kaimen Kagaku Co., Ltd.) at 20° C., 50% relative humidity.

The variation of the contact angle was measured at 20° C., 50% relative humidity. This measurement was started after repeated image formation of at least several sheets, when the photoreceptor has conformed to the image formation. When the photoreceptor was cylindrical, measurement was carried out at three positions—at the center and 5 cm from the right and left ends, and at four positions at each 90° in the circumferential direction—i.e. at a total of 12 positions. The average of these measurements was assumed as the contact angle, and the values farthest from this average value in the positive and negative directions were assumed as variations. Similarly, when the photoreceptor was a sheet, measurement was carried out at three positions—at the center and 5 cm from the right and left ends, and at four positions at an equally spaced interval—i.e. at a total of 12 positions. The average of these measurements was assumed as the contact angle of the present invention, and the values farthest from this average value in the positive and negative directions were assumed as variations. In this case, the aforementioned center refers to the center with respect to the length in the perpendicular direction relative to the rotating direction of the photoreceptor.

The fluorine-containing resin particles preferably have a number average primary particle size of not less than 0.02 μm and less than 0.20 μm and a crystallinity less than 90%. If the crystallinity is 90% or more, the dispersion property of the fluorine-containing resin particles will be improved, but the spreading property of fluorine-containing resin particles per se will be reduced, and the variation of contact angle tends to increase. There is no lower limit of the aforementioned crystallinity so long as an object of the present invention can be achieved. If the crystallinity of the fluorine-containing resin particles is too small, spreading property will be excessive and the dispersion property tends to deteriorate; therefore, the fluorine-containing resin particles are preferred to have a crystallinity of 40% or more.

To measure the crystallinity of the fluorine-containing resin particles, the diffraction peak having occurred is separated into crystalline and non-crystalline portions according to wide-angle X-ray diffraction measurement. After baseline correction, the measurement is expressed in terms of the percentage of the X-ray integrated intensity of the crystalline portion (numerator) over the full X-ray integrated integrity of the crystalline and non-crystalline portions (denominator).

In the present invention, measurements were made using the following wide-angle X-ray diffraction measuring apparatus under the following measuring conditions. If the same results as those by the wide-angle X-ray diffraction measuring apparatus can be obtained, another measuring instrument can be utilized.

X-ray generator: Rigaku RU-200B
Output: 50 kV, 150 mA
Monochromator: Graphite
Radiation source: CuKα (0.154184 nm)
Scanning range: $3 \leqq 2\theta \leqq 60$
Scanning method: θ-2θ
Scanning rate: 2/min As a material which constitutes fluorine-containing resin particles, it is desirable to use a homopolymer or a copolymer of a fluorine-containing polymerizable monomer, or a copolymer of a fluorine-containing polymerizable monomer and a fluorine free polymerizable monomer. A fluorine-containing polymerizable monomer is a monomer expressed with a general formula;

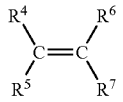

(In the formula, at least one group among $R^4$-$R^7$ is a fluorine atom, and the remaining groups are a hydrogen atom, a chlorine atom, a methyl group, a monofluoro methyl group, a difluoro methyl group, or a trifluoro methyl group independently, respectively). As a desirable fluorine-containing polymerizable monomer, ethylene tetrafluoride, ethylene trifluoride, ethylene chloride trifluoride, propylene hexafluoride, vinyl fluoride, vinylidene fluoride, ethylene dichloride difluoride, etc. may be listed. As a fluorine-containing polymerizable monomer, two or more kinds of monomers may be used.

As a fluorine free polymerizable monomer, vinyl chloride etc. may be listed, for example. As a fluorine free polymerizable monomer, two or more kinds of monomers may be used.

Among the constituting materials, it may be preferable to constitute any fluorine-containing resin particles by a homopolymer or a copolymer of a fluorine-containing polymerizable monomer, it may be more preferable to use a poly ethylene tetrafluoride (PTFE), poly ethylene trifluoride, and ethylene tetrafluoride-propylene hexafluoride copolymer and polyvinylidene fluoride, and it may be especially preferable to use poly ethylene tetrafluoride.

The number average molecular weight of a polymer which constitutes a fluorine-containing resin particle is not restricted especially as far as a object of the present invention can be attained, however usually the range of 10,000 to 1 million is suitable.

Although the degree of crystallinity of fluorine-containing resin particles changes according to the construction materials of the fluorine-containing resin particles, it is changed also by conducting heat-treating for the fluorine-containing resin particles. For example, if PTFE fine particles (polyethylene terephthalate fine particles) whose number average primary particle diameter is 0.12 μm and degree of crystallinity is 91.3 are heat-treated for 65 minutes at 250° C., degree of crystallinity can be reduced to 82.8. A heat treatment device in particular is not restricted, but a well-known dryer or a well-known heating furnace can be used.

As a binder resin in the above-mentioned surface layer, it is desirable to use a resin which has a surface activity group to help the dispersibility of fluorine-containing resin particles in a partial structure of the resin, for example, it is desirable to use polycarbonate and polyarylate which have a siloxane group in a partial structure. Especially, siloxane-modified polycarbonate which has a siloxane group shown below in a partial structure is desirable.

(PC-1)

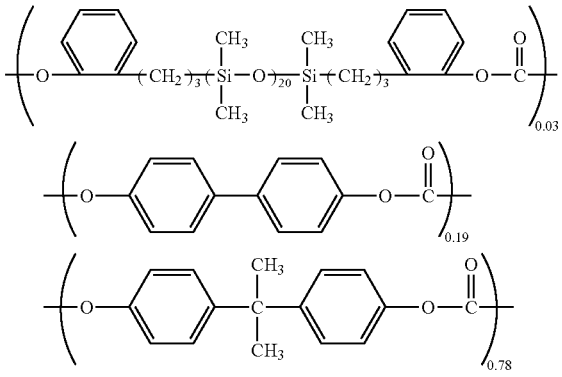

(PC-2)

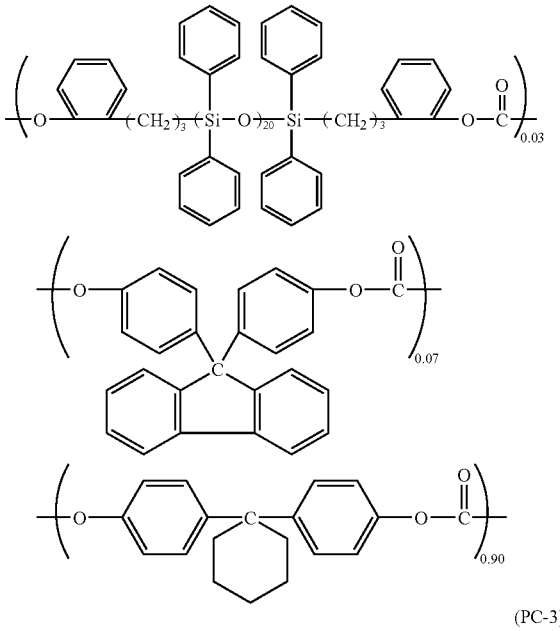

(PC-3)

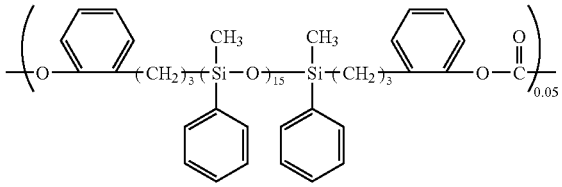

-continued

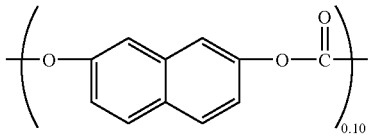

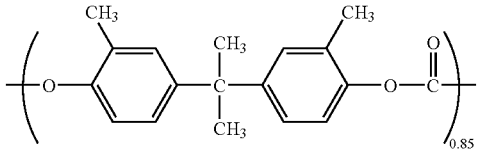

(PC-4)

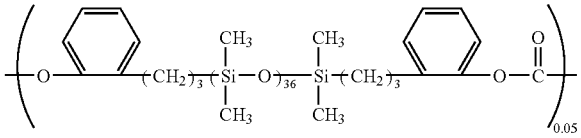

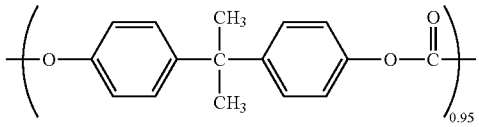

(PC-5)

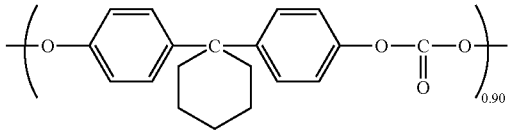

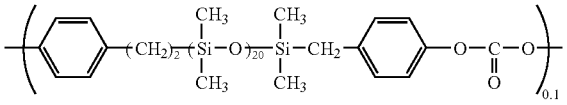

As for viscosity average molecular weight, 10,000-100,000 are desirable.

Further, to form by using the fluorine-containing resin particles a surface layer (or a charge injecting layer) whose contact angle for water is 90° or more and dispersion in a contact angle is ±2.0°, it is desirable to make the ratio of the fluorine-containing resin particles in the surface layer high, it is desirable to use it by an amount of at least 20 mass parts and not more than 200 mass parts to 100 mass parts of the binder resin by a mass ratio. With this range, it is easy to form the surface layer satisfying both conditions that a contact angle for water is 90° or more and a dispersion in a contact angle is ±2.0°. Moreover, a surface layer becomes firm and it is hard to generate an abrasion mark etc.

The following describes the configuration of the organic photoreceptor.

The organic photoreceptor refers to an electrophotographic photoreceptor equipped with at least one of a charge generating function essential to the configuration of the electrophotographic photoreceptor, and a charge transport function. It includes all the photoreceptors composed of the commonly known organic charge generating substances or organic charge transfer substances, and the known organic photoreceptors such as the photoreceptor wherein the charge generating function and charge transfer function are provided by the high-molecular complex.

There is no restriction to the configuration of the photoreceptor if the surface layer of the photoreceptor contains the fluorine-containing resin particles having a number average primary particle diameter from 0.02 μm inclusive to 0.20 μm exclusive, and the variation of contact angle is within ±2.0°. For example, it includes the following configurations:

1) A configuration wherein the photosensitive layer includes a charge generating layer, and a charge transport layer laid sequentially one on top of the other on a conductive support.

2) A configuration wherein the photosensitive layer includes a charge generating layer and the first and second charge transport layers laid sequentially one on top of another on a conductive support.

3) A configuration wherein the photosensitive layer includes a single layer containing a charge transport material and a charge generating material laid on a conductive support.

4) A configuration wherein the photosensitive layer includes a charge transport layer and a charge generating layer laid sequentially one on top of the other on a conductive support.

5) A configuration of the photoreceptor described in the aforementioned 1) through 5) wherein a surface protective layer is further provided.

The photoreceptor can be made in any one of the aforementioned configurations. The surface layer of the photoreceptor is the layer in contact with the air boundary. When a single layer photosensitive layer alone is formed on the conductive support, this photosensitive layer corresponds to the surface layer. When a single layer or a laminated photosensitive layer and surface protective layer are laid on the conductive support, the surface protective layer serves as a surface layer. In the photoreceptor, the configurations (2) may be preferably used. In the photoreceptor, a substrate layer may be formed on the conductive support, prior to the formation of the photosensitive layer, independently of the type of configuration adopted.

The charge transport layer can be defined as a layer having a function of transporting the electric charge carrier generated on the charge generating layer due to light exposure, to the surface of the organic photoreceptor. Specific detection of the charge transport function can be confirmed by laying the charge generating layer and charge transport layer on the conductive support, and by detecting the photoconductivity.

The following describes a specific configuration of the photosensitive layer, with reference to an example of the layer configuration (2):

Conductive Support:

A sheet-like or cylindrical conductive support may be used as the conductive support for the photoreceptor.

The cylindrical conductive support can be defined as a cylindrical support required to form images on an endless basis through rotation. The preferred cylindricity is 5 through 40 μm, and the more preferred one is 7 through 30 μm.

The cylindricity is based on the JIS (B0621-1984). To be more specific, when a cylindrical substrate is sandwiched between two coaxial geometrical cylinders, the cylindricity is expressed in terms of the difference of the radii at the position where a space between two coaxial cylinders is minimized. In the present invention, the difference in the radii is expressed in "μm". The cylindricity is gained by measuring the roundness at a total of seven points—two points 10 mm from both ends of the cylindrical substrate, a center, and four points obtained by dividing the space between both points and the center into three equal parts. A non-contact type universal roll diameter measuring instrument (by Mitsutoyo Co., Ltd.) can be used for this measurement.

The conductive support may include a metallic drum made of aluminum, nickel or the like, a plastic drum formed by vapor deposition of aluminum, tin oxide, indium oxide or the like, or a paper/plastic drum coated with conductive substance. The conductive support is preferred to have a specific resistance of $10^3$ Ωcm or less at the normal temperature.

A conductive support wherein the alumite film provided with porous sealing treatment on the surface is formed may be used. Alumite treatment is normally carried out in the acid bath containing a chromium oxide, sulfuric acid, oxalic acid, phosphoric acid, sulfamic acid or others. In sulfuric acid, the best result is obtained by anodization. In the case of anodization in sulfuric acid, preferred conditions include a sulfuric acid concentration of 100 through 200 g/l, aluminum ion concentration of 1 through 10 g/l, liquid temperature of around 20° C., and applied voltage of about 20 volts, without the preferred conditions being restricted thereto. The average thickness of the film formed by anodization is normally equal to or smaller than 20 μm, and is preferred to be equal to or smaller than 10 μm, in particular.

Intermediate Layer:

An intermediate layer equipped with barrier function can be provided between the conductive support and photosensitive layer To improve the adhesion between the conductive support and photosensitive layer and to avoid injection of electric charge from the support, an intermediate layer (including the substrate layer) can be provided between the support and photosensitive layer. The intermediate layer is made of a polyamide resin, polyvinyl chloride resin, vinyl acetate resin or copolymer resin including two or more recurring units of these resins. Polyamide resin is a preferred material as the resin where the residual potential increased by the repeated use of these substrate resins can be reduced. The preferable film thickness of the intermediate layer using these resins is 0.01 through 0.5 μm.

The preferable intermediate layer includes the intermediate layer made of the metallic resin created by thermosetting the organic metal compounds such as silane coupling agent and titanium coupling agent. The preferable film thickness of the intermediate layer is 0.1 through 2 μm.

The preferable intermediate layer includes the one obtained by dispersing the inorganic particles in the binder resin. The preferable average diameter of the inorganic particles is 0.01 through 1 μm. The particularly preferred one is the intermediate layer obtained by dispersing the N-type semiconductive fine particles in the binder. It can be exemplified by the intermediate layer prepared by dispersing the titanium oxide in the polyamide resin, wherein this titanium oxide has been subjected to silica/alumina treatment and surface treatment by silane compound, and has an average particle diameter of 0.01 through 1 μm. The preferable film thickness of the intermediate layer is 1 through 20 μm.

N-type semiconductive fine particle means that main charge carriers are particles of electrons. That is, since main charge carriers are particles of electrons, the intermediate layer in which the N-type semiconductive fine particles are contained in the insulating binder, effectively blocks the hole injection from the substrate and has a property having no blocking capability for the electron from the photosensitive layer.

The following describes the method of identifying the N-type semiconductive particles.

An intermediate layer having a film thickness of 5 μm (intermediate layer formed by using a dispersion having 50 wt % of particles dispersed in the binder resin constituting the intermediate layer) is formed on the conductive support. This intermediate layer is negatively charged and the light damping property is evaluated. Further, it is positively charged, and the light damping property is evaluated in the same manner.

The N-type semiconductive particles are defined as the particles dispersed in the intermediate layer in cases where the light damping property, when negatively charged in the aforementioned evaluation, is greater than that when positively charged.

The N-type semiconductive particles include the particles of titanium oxide ($TiO_2$), zinc oxide (ZnO) and tin oxide ($SnO_2$), and the titanium oxide is preferable.

The number average primary particle diameter is preferably 10 nm or more without exceeding 500 nm, more preferably 10 through 200 nm, and particularly preferably 15 nm through 50 nm.

The intermediate layer using the N-type semiconductive particles where the number average primary particle diameter is within the aforementioned range permits dispersion in the layer to be made more compact, and is provided with sufficient potential stability and black spot preventive function.

In the case of titanium oxide, for example, the number average primary particle diameter of the aforementioned N-type semiconductive particles is scales up 10,000 times by a transmission electron microscope. Random 100 particles are observed as primary particles, and a number average diameter of the Feret's diameter is obtained by image analysis in this measurement.

The N-type semiconductive particles are configured in a branched, needle-shaped or granular form. These N-type semiconductive particles—for example, in the case of titanium oxide—are available in various crystal types such as anatase type, rutile structure and amorphous type. Any of these crystal types may be utilized. A combination of two or more crystal types may also be used. Of these types, the rutile type is particularly preferred.

In one of the methods for surface treatment by hydrophobisation applied to the N-type semiconductive particles, surface treatment is carried out several times, and the last surface treatment operation in the surface treatment conducted several times is the one conducted by using a reactive organic silicon compound. It is preferred that at least one surface treatment operation in the process of surface treatment conducted several times should use the one using at least one of alumina, silica and zirconium. It is also preferred that the surface treatment using the reactive organic silicon compound should be conducted in the final operation.

Treatment by alumina, silica and zirconium refers to the treatment wherein alumina, silica and zirconium are deposited on the surface of the N-type semiconductive particles. The alumina, silica and zirconium deposited on the surface contain the hydrates of alumina, silica and zirconium. The surface treatment of reactive organic silicon compound is the treatment made by using the reactive organic silicon compound as a treatment solution.

As described above, uniform coating (surface treatment) of the surface of the N-type semiconductive particles is ensured by conducting surface treatment of the N-type semiconductive particles such as titanium oxide at least twice. If the N-type semiconductive particles having been subjected to surface treatment are used in the intermediate layer, it is possible to get a photoreceptor characterized by excellent dispersion property of the N-type semiconductive particles such as titanium oxide particles used in the intermediate layer, and by complete absence of an image defect such as a black spot.

Lightsensitive Layer

Charge Generating Layer

It is desirable for the organic photoreceptor to use an electric charge generating substance which has high sensitiveness characteristics to a wave length region of 350 nm-500 nm as an electric charge generating substance. As such an electric charge generating substance, an azo pigment, a perylene pigment, a sensitive quinone pigment, etc. are used preferably.

CGM-1

(1)

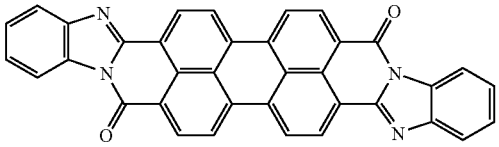

(2)

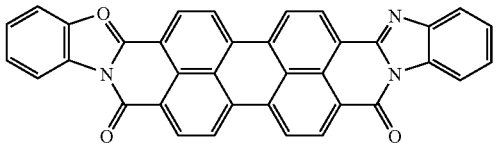

Mixture of (1) and (2)

CGM-2

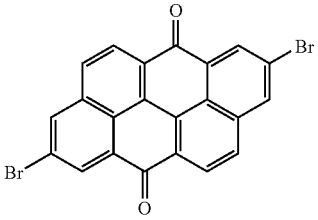

CGM-3

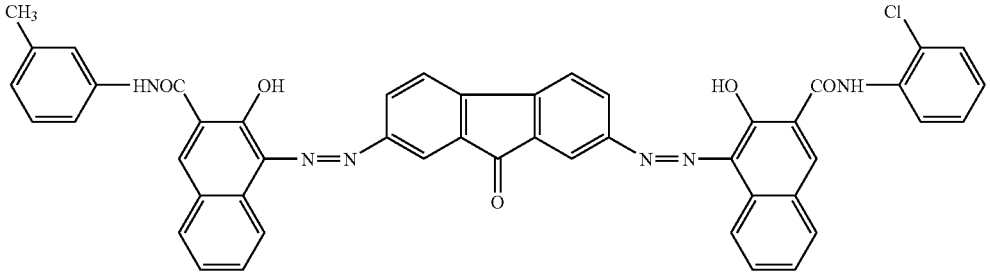

-continued

CGM-4

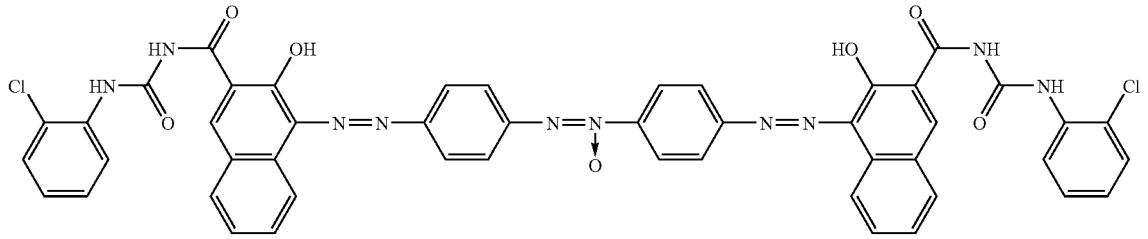

In case of using a binder as a dispersing medium of a CGM in the charge generating layer, a known resin can be employed for the binder, and the most preferable resins are butyral resin, silicone resin, silicone modification butyral resin, phenoxy resin. The ratio between the binder resin and the charge generating material is preferably binder resin 100 weight part for charge generating material 20 to 600 weight part. Increase in residual electric potential with repeated use can be minimized by using these resins. The layer thickness of the charge generating layer is preferably in the range of 0.3 to 2 mm.

Charge Transporting Layer

As described above, the structure which constitutes the charge transporting layer from plural charge transporting layers and make a charge transporting layer of the top layer contain fluorine based resin particles is preferable.

A charge transporting layer contains a charge transporting material (CTM) and a binder resin for dispersing the CTM and forming a layer. In addition to the fluorine based resin particles, the charge transporting layer may contain additives such as an antioxidant agent if necessary.

As a charge transporting material (CTM), a known charge transporting material (CTM) of the positive hole transportation type (P type) can be used. For example, triphenylamines, hydrazones, styryl compound, benzidine compound, butadiene compound can be applied. These charge transporting materials are usually dissolved in a proper binder resin to form a layer.

CTM-1

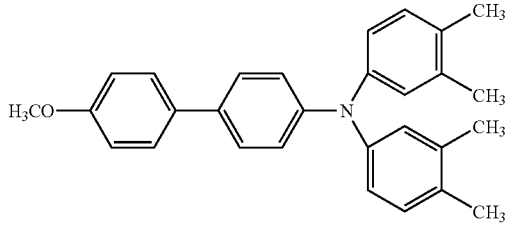

CTM-2

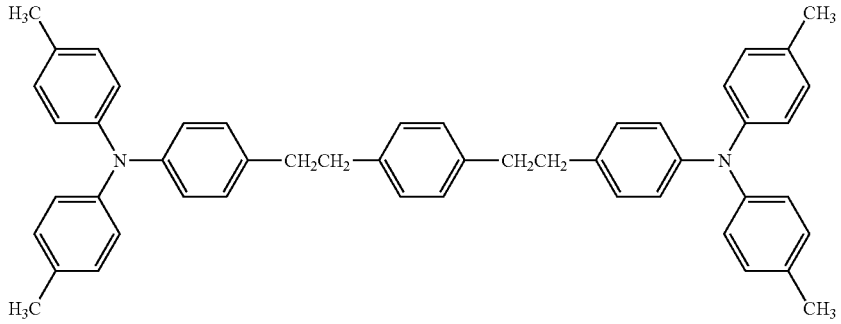

CTM-3

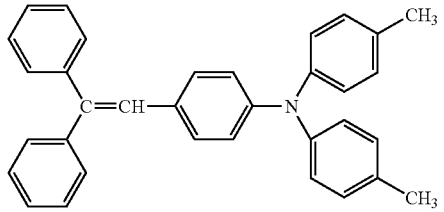

CTM-4

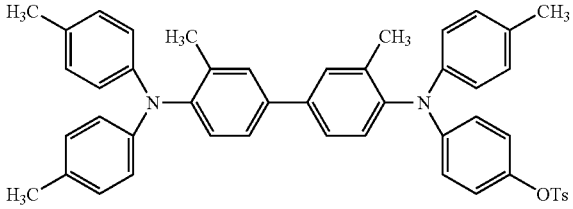

-continued

CTM-5

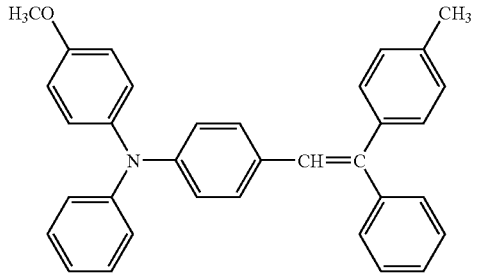

As the binder resin for charge transporting layer (CTL), any one of thermoplastic resin and thermosetting resin may be used. For example, polystyrene, acryl resin, methacrylic resin, vinyl chloride resin, vinyl acetate resin, polyvinyl butyral resin, epoxide resin, polyurethane resin, phenol resin, polyester resin, alkyd resin, polycarbonate resin, silicone resin, melamine resin range and copolymer resin including more than repetition units of two resins among these resins may be usable. Further, other than these insulation-related resin, high polymer organic semiconductor such as poly -N-vinyl carbazole may be usable. The most preferred material is polycarbonate resin in view of, smaller water absorbing rate, dispersing ability of the CTM and electro photosensitive characteristics.

Ratio of the binder resin is preferably 50 to 200 parts by mass to 100 parts of charge transporting material by weight. Total thickness of the charge transporting layer is preferably less than 20 μm, more preferably 10-16 μm. If the layer thickness exceeds 20 μm, the absorption or scattering of the short wave laser becomes large, then lowering of the sharpness and increasing of a residual voltage tends to take place.

Moreover, it is preferable to make the surface layer containing the fluorine-containing resin particles contain an antioxidant. Although the surface layer containing a fluorine-containing resin particles tends to oxidize with activated gas at the time of charging of a photoreceptor, for example, NOx, ozone, etc., and easily generates a blur image, the occurrence of a blur image can be prevented by making an antioxidant exist together with it. Here, as an added amount of the antioxidant, 0.1 parts to 50 parts is to 100 parts of binders in the surface phase, preferably 0.5 parts to 25 parts. The antioxidant is a material, as a typical one, having a character to prevent or control an action of oxygen under conditions, such as light, heat, and electric discharge, to an auto-oxidizing substance which exists in an organic photoreceptor or on the surface of an organic photoreceptor. Typically, the following compound groups are listed.

1-1

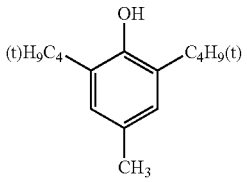

1-2

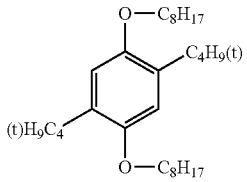

1-3

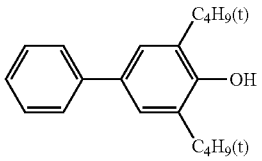

1-4

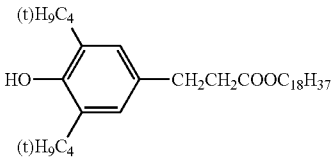

1-5

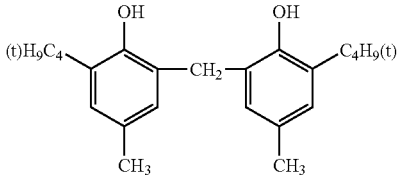

1-6

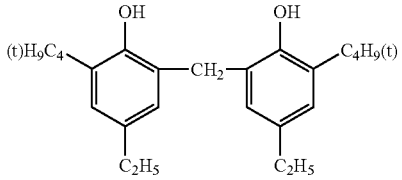

-continued
1-7
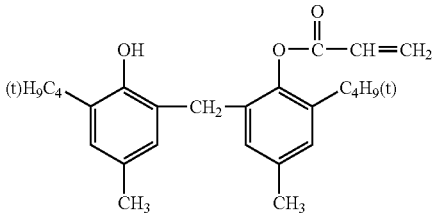
1-8
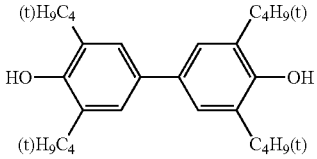
1-9
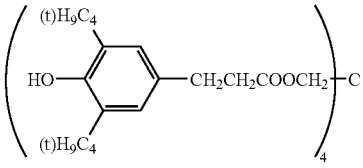
1-10
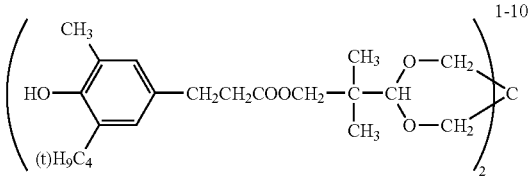
1-11
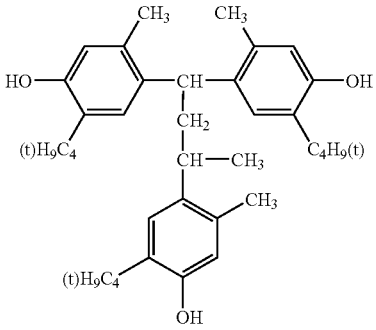
2-1
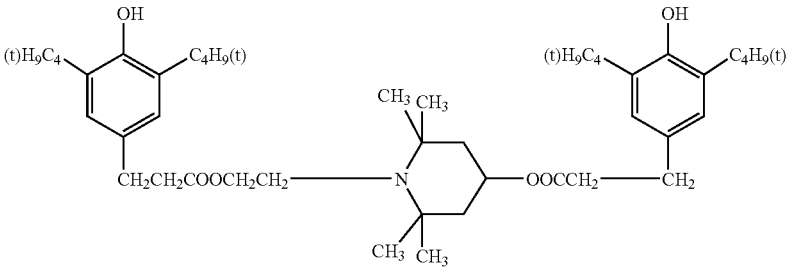
2-2
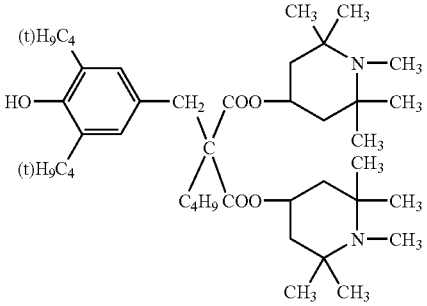
2-3
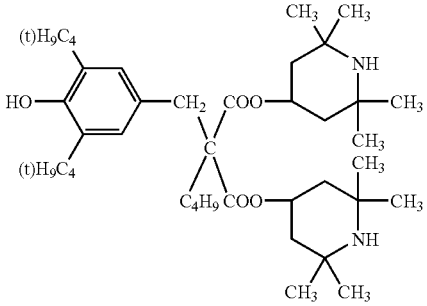

-continued
2-4
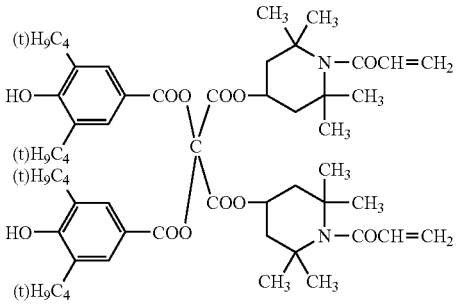
2-5
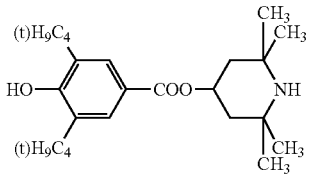
2-6
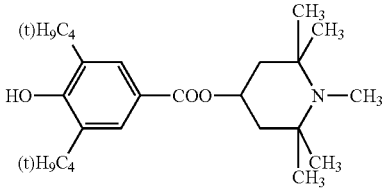
2-7
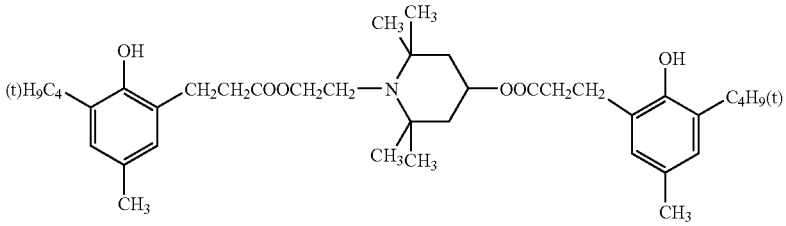
2-4
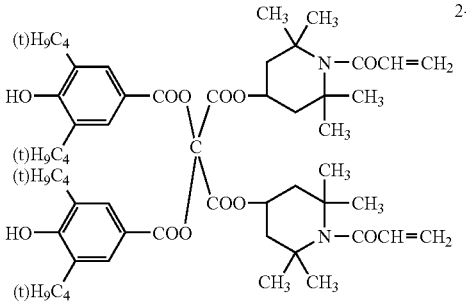
2-5
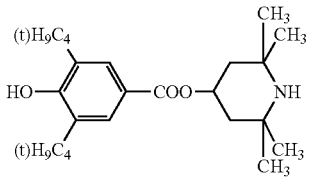
2-6
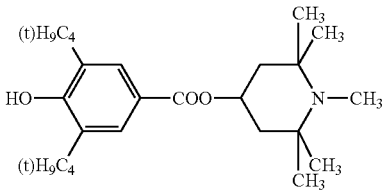

-continued 2-7

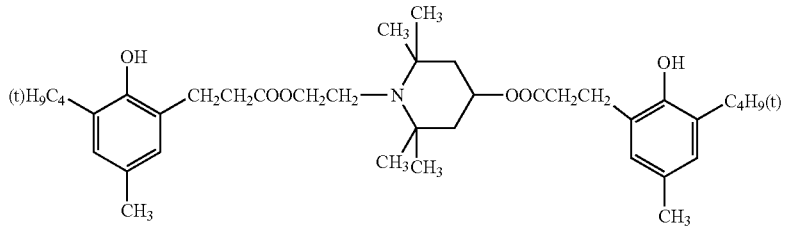

As a solvent or a dispersion medium used for forming an intermediate layer, a photosensitive layer and a protective layer, n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethyl sulfoxide and methyl cellosolve may be listed. The present invention is not restricted to these one, dichloromethane, 1,2-dichloro ethane and methyl ethyl ketone are used preferably. Further, these solvents or dispersion media may also be used either independently or as mixed solvents of two or more types.

On the other hand, although a developer is not specifically limited, it may be preferable to use toner with a small water content and sharp particle size distribution. For example, if a 50% number particle size of toner particles is set to Dp50, toner whose content of toner particles having particle size of 0.7×(Dp50) or less is eight or less number % and whose water content is 0.1-2.0 weight % may be used preferably.

If the content of toner particles having particle size of 0.7×(Dp50) or less exceeds eight number %, since an occupation ratio of a smaller particle diameter component increases, and it may become causes, such as an increase in weak charging toner, occurrence of the toner of reverse polarity, or occurrence of over charging toner. As a result, dot reproducibility of a toner image on an organic photoreceptor tends to deteriorate. Further, toner scattering occurs, a dot image becomes an excessive large image or an excessive small image so that the dot reproducibility becomes degraded. Furthermore, toner transferring ability and cleaning ability are lowered, the dot reproducibility of a toner image may be reduced further more, and sharpness may be lowered more.

Moreover, in the present invention, it was found that the water content of toner may be strongly related to a static-charge buildup and charge holdout capability of toner, and when the water content is the range of 0.1-2.0 mass % with toner which has the above-mentioned distribution characteristics, and the charging buildup and charge holdout capability of toner becomes excellent. When the water content is 0.1 weight % or less, the static-charge buildup capability of toner is lowered, weak charging toner tends to occur, toner scattering occurs and dot reproducibility tends to be lowered. On the other hand, when the water content is 2.0 weight % or more, it may cause an occurrence of the toner of reverse polarity and an occurrence of over charging toner. At the same time of the occurrence of toner scattering, toner transferring ability and cleaning ability are lowered and dot reproducibility is also lowered.

Further, in a particle size distribution of toner the ratio (Dv50/Dp50) of toner particles of 50% volume particle diameter (Dv50) and 50% number particle diameter (Dp50) is preferably 1.0-1.15, is more preferably 1.0-1.10.

Further, the ratio (Dv70/Dp70) of the cumulative 75% volume particle diameter (Dv75) to the cumulative 75% number particle diameter from the largest particle may be preferably 1.0 to 1.10. When the ratio exceeds 1.10, an occupation ratio of a smaller particle diameter component increases, and it may become causes, such as an increase in weak charging toner, occurrence of the toner of reverse polarity, or occurrence of over charging toner. As a result, dot reproducibility of a toner image on an organic photoreceptor tends to deteriorate.

Incidentally, the diameter of toner represented by a median value based on volume, i.e., the above-mentioned 50% volume particle size, (Dv50) is preferably 2-9 μm, more preferably 3-7 μm. By making it within this range, a resolution can be made high. Further, by combining above-mentioned range, in spite of a small particle diameter toner, the amount of existence of toner of a fine particle size can be lessened, the reproducibility of a dot image can be improved over a long period of time, and a stable picture image with excellent sharpness can be formed.

The cumulative 75 percent volume particle diameter (Dv75) or the cumulative 75 number particle diameter from the largest particle, as described herein, refers to the volume particle diameter or the number particle diameter at the position of the particle size distribution which shows 75 percent of the cumulative frequency with respect to the sum of the volume or the sum of the number from the largest particle.

Particle size distribution, 50 percent volume particle diameter (Dv50), 50 percent number particle diameter (Dp50), cumulative 75 percent volume particle diameter (Dv75), and cumulative 75 percent number particle diameter (Dp75) can be measured and calculated by the use of an instrument in which a computer system (made by Beckman Coulter company) for processing data is connected to Coulter Multisizer III ((made by Beckman Coulter company).

As a procedure, after 0.02 g of toner is made to familiar with 20 ml of a surface-active agent solution (for example, a surface-active agent solution in which a neutral detergent including a surface-active agent is diluted with pure water by 10 times), the solution is subjected to a ultrasonic dispersing process for one minutes so as to produce a toner dispersion.

This toner dispersion is put into a beaker with a pipet until the measurement concentration becomes 5% to 10% and measurement is conducted by set a count of a measuring device to be 2500 pieces. Incidentally, an aperture diameter of 50 μm was used.

In the technical field in which electrostatic latent images are visualized employing dry system development, as an electrostatic image developing toner employed are those which are prepared by adding external additives to colored particles containing at least colorants and resins. However, as long as specifically there occur no problems, it is generally described that colored particles are not differentiated from the electrostatic latent image developing toner. The particle diameter and particle size distribution of the colored particles result in the same measurement values as the electrostatic latent image developing toner.

The particle diameter of external agents is in an order of nm in terms of the number average primary particle. It is possible to determine the diameter employing an Electrophoretic Light Scattering Spectrophotometer "ELS-800" (manufactured by Otsuka Electronics Co., Ltd.).

The structure as well as the production method of the toner will now be described.

<Toner>

Toner which may be prepared by pulverization method or polymerization method can be employed. Polymerization toner is preferably employed because toner having uniform particle size distribution is stably obtained.

The polymerization toner is prepared by polymerization of binder resin of toner from monomers, and if necessary, subsequent chemical process. Practically it includes polymerization process such as suspension polymerization and emulsion polymerization, and fusion process of particles conducted thereafter if necessary.

It is preferable that a coalesced type toner is employed, which is prepared by salting out and fusing resin particles comprising release agents and colorant particles.

As the reason for such toner, it is assumed that since it is possible to easily control the particle size distribution of the coalesced type toner and it is possible to prepare toner particles which exhibit uniform surface properties of each particle, the effects of the present invention are exhibited without degrading transferability.

The "salting-out/fusion", as described above, refers to simultaneous occurrence of salting-out (aggregation of particles) and fusion (disappearance of the boundary surface among particles) or an operation to render salting-out and fusion to occur simultaneously. In order to render salting-out and fusion to occur simultaneously, it is necessary to aggregate particles (resin particles and colorant particles) at temperatures higher than or equal to the glass transition temperature (Tg) of resins constituting the resin particles.

Releasing Agent

The preferable releasing agent is exemplified.

$$R^1—(OCO—R^2)_n$$

In the formula n is an integer from 1 to 4, preferably from 2 to 4, and more preferably 3 or 4. $R^1$ and $R^2$ each represents a hydrocarbon group, which may have a substituent.

The number of carbon atoms in $R^1$ is from 1 to 40, preferably from 1 to 20, and more preferably from 2 to 5.

The number of carbon atoms in $R^2$ is from 1 to 40, preferably from 16 to 30, and more preferably from 18 to 26.

In the formula n is an integer from 1 to 4, preferably from 2 to 4, more preferably 3 or 4 and particularly 4.

The compound is synthesized by a dehydration condensation reaction of an alcohol compound and a carbonic acid adequately.

Most preferable example of the compound is pentaerythritoltetrabehanate.

Representative examples are listed as compounds 1 to 26.

1)

$$CH_3—(CH_2)_{12}—COO—(CH_2)_{17}—CH_3$$

2)

$$CH_3—(CH_2)_{18}—COO—(CH_2)_{17}—CH_3$$

3)

$$CH_3—(CH_2)_{20}—COO—(CH_2)_{21}—CH_3$$

4)

$$CH_3—(CH_2)_{14}—COO—(CH_2)_{19}—CH_3$$

5)

$$CH_3—(CH_2)_{20}—COO—(CH_2)_6—O—CO—(CH_2)_{20}—CH_3$$

6)

$$CH_3—(CH_2)_{20}—COO—(CH_2)_2—\overset{\overset{CH_3}{|}}{CH}—CH_2—O—CO—(CH_2)_{20}—CH_3$$

7)

$$CH_3—(CH_2)_{22}—COO—(CH_2)_2—\overset{\overset{CH_3}{|}}{CH}—CH_2—O—CO—(CH_2)_{22}—CH_3$$

8)

$$CH_3—(CH_2)_{22}—COO—CH_2—\underset{\underset{CH_3}{|}}{\overset{\overset{CH_3}{|}}{C}}—CH_2—O—CO—(CH_2)_{22}—CH_3$$

9)

$$CH_3—(CH_2)_{26}—COO—CH_2—\underset{\underset{CH_3}{|}}{\overset{\overset{CH_3}{|}}{C}}—CH_2—O—CO—(CH_2)_{26}—CH_3$$

10)

$$\begin{array}{l} CH_2—O—CO—(CH_2)_{26}—CH_3 \\ | \\ CH—O—CO—(CH_2)_{26}—CH_3 \\ | \\ CH_2—O—CO—(CH_2)_{26}—CH_3 \end{array}$$

11)

$$\begin{array}{l} CH_2—O—CO—(CH_2)_{22}—CH_3 \\ | \\ CH—O—CO—(CH_2)_{22}—CH_3 \\ | \\ CH_2—O—CO—(CH_2)_{22}—CH_3 \end{array}$$

12)

$$\begin{array}{l} CH_2—OH \\ | \\ CH—O—CO—(CH_2)_{26}—CH_3 \\ | \\ CH_2—O—CO—(CH_2)_{26}—CH_3 \end{array}$$

13)

$$\begin{array}{l} CH_2—OH \\ | \\ CH—O—CO—(CH_2)_{22}—CH_3 \\ | \\ CH_2—O—CO—(CH_2)_{22}—CH_3 \end{array}$$

-continued

14)

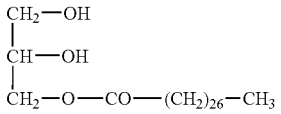

15)

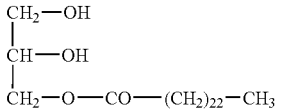

16)

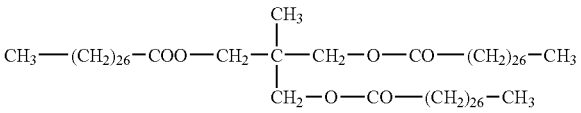

17)

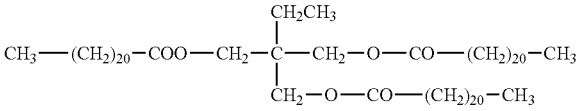

18)

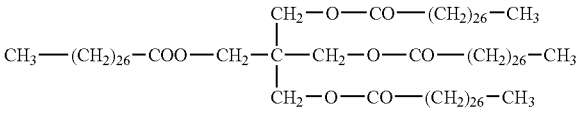

19)

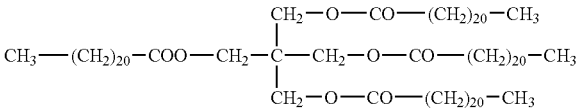

20)

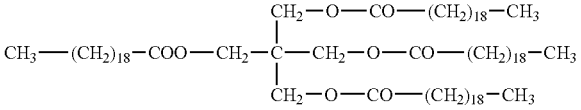

21)

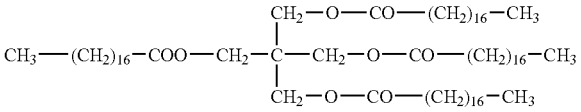

22)

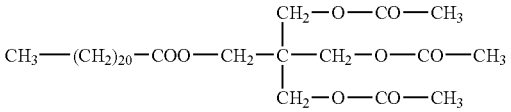

<Content of the Releasing Agent>

The content ratio of the releasing agent in the toner is commonly from 1 to 30 percent by weight, is preferably from 2 to 22 percent by weight, and is particularly preferably from 1 to 15 percent by weight.

<Resin Particles Comprising Releasing Agents>

The resin particles containing releasing agents may be obtained as latex particles by dissolving releasing agents in monomers to obtain binding resins, and then dispersing the resulting monomer solution into water based medium, and subsequently polymerizing the resulting dispersion.

Weight average particle size of the latex particles is preferably 50-2000 nm.

Listed as polymerization method employed to obtain resin particles, in which binding resins comprise releasing agents, may be granulation polymerization methods such as an emulsion polymerization method, a suspension polymerization method, a seed polymerization method, and the like.

The following method (hereinafter referred to as an "mini-emulsion method") may be cited as a preferable polymerization method to obtain resin particles comprising releasing agents. A monomer solution, which is prepared by dissolving releasing agents in monomers, is dispersed into a water based medium prepared by dissolving surface active agents in water at a concentration of less than the critical micelle concentration so as to form oil droplets in water, while utilizing mechanical force. Subsequently, water-soluble polymerization initiators are added to the resulting dispersion and the resulting mixture undergoes radical polymerization. Further, instead of adding said water-soluble polymerization initiators, or along with said water-soluble polymerization initiators, oil-soluble polymerization initiators may be added to said monomer solution.

Herein, homogenizers which results in oil droplets in water dispersion, utilizing mechanical force, are not particularly limited, and may include "CLEARMIX" (produced by M Tech Co., Ltd.) provided with a high speed rotor, ultrasonic homogenizers, mechanical homogenizers, Manton-Gaulin homogenizers, pressure type homogenizers, and the like. Further, the diameter of dispersed particles is generally 10 to 1,000 nm, and is preferably 30 to 300 nm.

<Binder Resins>

Binder resins, which constitute the toner, preferably comprise high molecular weight components having a peak, or a shoulder, in the region of 100,000 to 1,000,000, as well as low molecular weight components having a peak, or a shoulder, in the region of 1,000 to 20,000 in terms of the molecular weight distribution determined by GPC.

Herein, the method for measuring the molecular weight of resins, employing GPC, is as follows. Added to 1 ml of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.45 to 0.50 μm, the filtrate is injected in a GPC.

Measurement conditions of GPC are described below. A column is stabilized at 40° C., and THF is flowed at a rate of 1 cc per minute. Then measurement is carried out by injecting approximately 100 μl of said sample at a concentration of 1 mg/ml. It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G3000H, G4000H, G5000H, G6000H, G7000H, TSK guard column, and the like. Further, as a detector, a refractive index detector (IR detector) or a UV detector is preferably employed. When the molecular weight of samples is measured, the molecular weight distribution of said sample is calculated employing a calibration curve which is prepared employing monodispersed polystyrene as standard particles. Approximately ten polystyrenes samples are preferably employed for determining said calibration curve.

Material and preparation process of resin particles are described.

Monomer Material

Radical polymerizable monomer is necessary component, and crosslinking agent may be employed when necessary as the polymerizable monomer. It is preferred to contain at least one of the following radical polymerizable monomer having acid group or base group.

(1) Radical Polymerizable Monomer

Radical polymerizable monomer is employed without restriction. One, two or more monomers are employed in combination so as to satisfy the required characteristics.

Practically, aromatic vinyl monomer, (meta)acrylate monomer, vinyl ester monomer, vinyl ether monomer, monoolefin monomer, diolefin monomer, halogenated olefin monomer etc. are exemplified.

Examples of the aromatic vinyl monomer are styrene or styrene derivatives such as styrene, o-methylstyrene, m-methylstyrene, p-methylstyrene, p-methoxylstyrene, p-phenylstyrene, p-chlorostyrene, p-ethylstyrene, p-n-butylstyrene, p-t-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene.

Examples of the (meta)acrylic acid ester are methylacrylate, ethylacrylate, butylacrylate, 2-ethylhexylacrylate, cyclohexylacrylate, phenylacrylate, methylmethacrylate, ethylmethacrylate, butylmethacrylate, 2-ethylhexylmetaacrylate, β-hydroxymethacrylate, γ-aminopropylacrylate, stearylmethacrylate, dimethylaminoethyl methacrylate, and diethylaminoethyl methacrylate.

Examples of the vinyl ester monomer are vinyl acetate, vinyl propionate and vinyl benzoate.

Examples of the vinyl ether monomer are vinyl methyl ether, vinyl ethyl ether, vinyl isobutyl ether and vinyl phenyl ether.

Examples of the monoolefin monomer are ethylene, propylene, isobutylene, 1-butene, and 1-pentene, 4-methyl-1-pentene.

Examples of the diolefin monomer are butadiene, isoprene, and chloroprene.

Examples of the halogenated olefin monomer are vinyl chloride, vinylidene chloride, and vinyl bromide.

(2) Crosslinking Agent

Radical polymerizable crosslinking agent can be added so as to improve toner characteristics. Examples of the radical polymerizable crosslinking agent are those having two or more unsaturated bonds such as divinylbenzene, divinylnaphthalene, divinylether, diethyleneglycol methacrylate, ethyleneglycol dimethacrylate, polyethyleneglycol dimethacrylate and diallyl phthalate.

(3) Radical Polymerizable Monomer Having Acid Group or Base Group

Examples of the radical polymerizable monomer having acid group or base group are carboxyl group containing monomer, sulfonic acid containing monomer, and amine compound such as primary amine, secondary amine, tertiary amine, quaternary amine.

Examples of the carboxyl group containing monomer are acrylic acid, methacrylic acid, fumaric acid, maleic acid, itaconic acid, cinnamic acid, maleic monobutylate, maleic monooctylate.

Examples of the sulfonic acid group containing monomer are styrenesulfonic acid, allylsulfosuccinic acid, octyl allylsulfosuccinate.

These may be in the form of alkali metal salt such as sodium and potassium, or alkali earth metal salt such as calcium.

Examples of the radical polymerization monomer containing base is listed as amine compounds, specifically, dimethylaminoethylacrylate, dimethylaminoethylmetacrylate, diethylaminoethylacrylate, diethylaminoethylmetacrylate, and quaternary ammonium slat of the above four compounds, 3-dimethylaminophenylacrylate, 2-hydroxy-3-methacryloxy propyl trimethylammonium salt, acrylamide, N-butylacrylamide, N,N-dibutyl acrylamide, piperidyl acrylamide, metacrylamide, N-butylmetacrylamide, N-octadecyl acrylamide; vinyl N-methylpyridinium chloride, vinyl N-ethyl pyridinium chloride, N,N-diallyl methylammonium chloride and N,N-diallyl ethylammonium chloride.

As for the amount of the radical polymerization monomer, radical polymerizable monomer containing acid group or base group is 0.1 to 15 weight % with reference to the total amount of the monomers. The amount of the radical polymerization crosslinking agent, which varies depending on its property, is 0.1 to 10 weight % with reference to the whole radical polymerizable monomers.

[Chain Transfer Agents]

Aiming at the adjustment of molecular weight, generally used chain transfer agents may be employed.

The chain transfer agents are not specially limited. Examples include mercapatans such as octylmercaptan, dodecylmercaptan, tert-dodecylmercaptan, etc.

[Polymerization Initiators]

Water-soluble radical polymerization initiators may be optionally employed. For example, are listed persulfate salts (potassium persulfate, ammonium persulfate, etc.), azo series compounds (4,4'-azobis-4-cyano maleic acid and its salt, 2,2'-azobis(2-amodinopropane) salt, etc. peroxide compounds.

Furthermore, the above-mentioned radical polymerization initiator may be employed in combination with a reducing agent if desired, and may be employed as a redox system initiator. The use of the redox system initiator enables the increase in polymerization activity and the decrease in polymerization temperature. As a result, the reduction in polymerization time may be expected.

The polymerization temperature is not limited if the temperature is higher than the lowest temperature at which the polymerization initiator induces the formation of a radical. The temperature of 50° C. to 90° C. is employed. However, the use of the polymerization initiator such as, for example, a combination of hydrogen peroxide-reducing agent (ascorbic acid, etc.) which enables initiation at room temperature makes it possible to conduct the polymerization at room temperature or lower.

[Surface Active Agents]

Surface active agent is employed in polymerization using the radical polymerizable monomer.

Surface active agents include sulfonic acid salts such as sodium dodecylbenzenesulfonate, sodium arylalkylpolyethersulfonate, sodium 3,3-disulfondiphenylurea-4,4-diazo-bis-amino-8-naphthol-6-sulfonate, ortho-carboxybenzene-azo-demethylaniline, sodium 2,2,5,5-tetramethyl-triphenylmethane-4,4-diazo-bis-β-naphthol-6-sulfonate, etc., sulfonic ester salts such as sodium tetradecylsulfate, sodium pentadecylsulfate, sodium octylsulfate, etc., fatty acid salts such as sodium oleate, sodium laurate, sodium caprate, sodium caprylate, sodium caproate, potassium stearate, calcium oleate, etc.

Further, nonionic surfactant also may be employed. Examples are mentioned as polyethyleneoxide, polypropyleneoxide, combination of polypropyleneoxide and polyethyleneoxide, ester of polyethyleneglycol and higher fatty acid, alkylphenol polyethyleneoxide, ester of higher fatty acid and polyethylene glycol, ester of higher fatty acid and polypropyleneoxide, sorbitan ester.

[Colorants]

Colorants include inorganic pigments and organic pigments.

Inorganic Pigments

Inorganic pigments capable of employing in the toner may be employed. Specific inorganic pigments are shown in the following.

Black pigments include, for example, carbon blacks such as firness black, channel black, acetylene black, thermal black, lamp black, etc., and in addition, magnetic powders such as magnetite, ferrite, etc.

These inorganic pigments may be employed individually or in combination in accordance with requirements. Furthermore, the addition amount of the pigment is generally in the range of 2 to 20 weight parts of a polymer and preferably in the range of 3 to 15 weight parts.

Magnetite mentioned above may be added when used as a magnetic toner. Preferable amount is 20 to 60% by weight in the toner.

Organic Pigments

Organic pigments which may be employed in toner may be employed. In the following, specific organic pigments are shown.

Pigments for magenta or red include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48: 1, C.I. Pigment Red 53: 1, C.I. Pigment Red 57: 1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, etc.

Pigments for orange or yellow include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 138, C.I. Pigment Yellow 180, C.I. Pigment Yellow 185, C.I. Pigment Yellow 155, C.I. Pigment Yellow 156, etc.

Pigments for green or cyan include C.I. Pigment Blue 15, C.I. Pigment Blue 15: 2, C.I. Pigment Blue 15: 3, C.I. Pigment Blue 16, C.I. Pigment Blue 60, C.I. Pigment Green 7, etc.

Further, as for die, C.I. solvent red 1, C.I. solvent red 49, C.I. solvent red 52, C.I. solvent red 58, C.I. solvent red 63, C.I. solvent red 111, C.I. solvent red 122, C.I. solvent yellow 19, C.I. solvent red 122, C.I. solvent yellow 44, C.I. solvent red 122, C.I. solvent yellow 77, C.I. solvent red 122, C.I. solvent yellow 79, C.I. solvent red 122, C.I. solvent yellow 81, C.I. solvent red 122, C.I. solvent yellow 82, C.I. solvent red 122, C.I. solvent yellow 93, C.I. solvent red 122, C.I. solvent yellow 98, C.I. solvent red 122, C.I. solvent yellow 103, C.I. solvent red 122, C.I. solvent yellow 104, C.I. solvent red 122, C.I. solvent yellow 112, C.I. solvent red 122, C.I. solvent yellow 162, C.I. solvent red 122, C.I. solvent blue 25, C.I. solvent blue 36, C.I. solvent blue 60, C.I. solvent blue 70, C.I. solvent blue 93, C.I. solvent blue 95 may be used.

These organic pigments may be employed individually or in combination of a plurality of them in accordance with requirements. Furthermore, the addition amount of the pigment is generally in the range of 2 to 20 weight parts for a polymer and preferably in the range of 3 to 15 weight parts.

Surface Improving Agents

The colorant may be used after subjecting to surface modification by employing surface improving agent. Specifically, may be preferably employed silane coupling agent, titanium coupling agent, aluminum coupling agent, etc.

[External Additive]

The so-called external additive can be employed for the purpose of improving fluid characteristics or cleaning ability so as to give an adaptability of recycle toner. The external additive includes various inorganic particles, organic particles and lubricant.

Inorganic particles may be used as external. Preferably employed as inorganic particles are fine particles of silica, titania and alumina. These inorganic fine particles are preferably hydrophobic. Specific example of silica fine particles, includes marketing product of R-805 R-976, R-974, R-972, R-812 and R-809 made by Nihon Aerosil Co., Ltd., HVK-2150 and H-200 made by Hoechst Company, and TS-720 TS-530, TS-610, H-5, MS-5 made by Cabot company.

Example of titanium fine particles includes marketing product of T-805 and T-604 made by Nihon Aerosil Co., Ltd., MT-100S, MT-100B, MT-500BS, MT-600, MT-600SS and JA-1, made by Teika company, TA-300SI, TA-500, TAF-130, TAF-510 and TAF-510T made by Fuji Titanium Company, and IT-S, IT-OA, IT-OB, IT-OC made by Idemitsu Kosan Company.

Example of alumina fine particles includes marketing product RFY-C and C-604 made by Nihon Aerosil Co. Ltd., and TTO-55 made by Ishihara Sangyo company is made.

As organic fine particles, spherical organic fine particles having number average primary order particle size of 10 to 2000 nm may be used. Examples of the organic fine particles are listed as homopolymer or copolymer of styrene resin, methylmethacrylate resin.

Example of the lubricant mentioned above includes metallic salt of higher fatty acid such as stearic acid salt of zinc, aluminum, copper and magnesium, oleic acid salt of calcium, zinc, manganese, iron, copper and magnesium, palmitic acid salt of zinc, copper, magnesium and calcium, linoleic acid salt of zinc and calcium, and ricinoleic acid salt of zinc and calcium.

The external additives are preferably contained in amount of 0.1 to 5 weight % with reference to toner amount.

Preferable toner is a coalesced type toner obtained by salting out/fusing resin particles comprising releasing agents and colorant particles in a water based medium. By salting out/fusing said resin particles comprising releasing agents, as described above, a toner is obtained in which said releasing agents are finely depressed.

In addition, the coalesced type toner possesses an uneven surface from the production stage. Therefore, differences in the shape as well as surface properties among toner particles are minimal. As a result, the surface properties tend to be uniform. Thus difference in fixability among toner particles tends to be minimized so that it is possible to maintain excellent fixability.

<Toner Production Process>

One example of the method for producing the toner of the present invention is as follows:

(1) a dissolution process in which releasing agents are dissolved in monomers and a monomer solution is prepared (2) a dispersion process in which the resulting monomer solution is dispersed into a water based medium (3) a polymerization process in which the resulting water based dispersion of said monomer solution undergoes polymerization so that dispersion (latex) of resin particles comprising said releasing agents is prepared (4) a salting-out/fusion process in which the resulting resin particles and said colorant particles are subjected to salting-out/fusion in a water based medium so as to obtain coalesced particles (toner particles)

(5) a filtration and washing process in which the resulting coalesced particles are collected from the water based medium employing filtration, and surface active agents and the like are removed from said coalesced particles (6) a drying process in which washed coalesced particles are dried, and (7) an external addition process may be included in which external agents are added to the dried coalesced particles.

(Dissolution Process)

Methods for dissolving releasing agents in monomers are not particularly limited.

The dissolved amount of said releasing agents in said monomers is determined as follows: the content ratio of releasing agents is generally 1 to 30 percent by weight with respect of the finished toner, is preferably 2 to 20 percent by weight, and is more preferably 3 to 15 percent by weight.

Further, oil-soluble polymerization initiators as well as other oil-soluble components may be incorporated into said monomer solution.

(Dispersion Process)

Methods for dispersing said monomer solution into a water based medium are not particularly limited. However, methods are preferred in which dispersion is carried out employing mechanical force. Said monomer solution is preferably subjected to oil droplet dispersion (essentially an embodiment in a mini-emulsion method), employing mechanical force, especially into a water based medium prepared by dissolving a surface active agent at a concentration of lower than its critical micelle concentration.

Herein, homogenizers to conduct oil droplet dispersion, employing mechanical forces, are not particularly limited, and include, for example, "CLEARMIX", ultrasonic homogenizers, mechanical homogenizers, and Manton-Gaulin homogenizers and pressure type homogenizers. Further, the diameter of dispersed particles is 10 to 1,000 nm, and is preferably 30 to 300 nm.

(Polymerization Process)

In the polymerization process, polymerization methods (granulation polymerization methods such as an emulsion polymerization method, a suspension polymerization method, and a seed polymerization method) may be employed.

Listed as one example of the preferred polymerization method may be a mini-emulsion method, namely in which radical polymerization is carried out by adding water-soluble polymerization initiators to a dispersion obtained by oil droplet dispersing a monomer solution, employing mechanical force, into a water based medium prepared by dissolving a surface active agent at a concentration lower than its critical micelle concentration.

(Salting-out/Fusion Process)

In the salting-out/fusion process, a colorant particle dispersion is added to a dispersion containing resin particles obtained by said polymerization process so that said resin particles and said colorant particles are subjected to salting-out/fusion in a water based medium.

Further, in said salting-out/fusion process, resin particles as well as colorant particles may be fused with internal agent particles and the like.

"Water based medium", as described in said salting-out/fusion process, refers to one in which water is a main component (at least 50 percent by weight). Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

It is possible to prepare colorant particles employed in said salting-out/fusion process by dispersing colorants into a water based medium. Dispersion of colorants is carried out in such a state that the concentration of surface active agents in water is adjusted to at least critical micelle concentration.

Homogenizers to disperse colorants are not particularly limited, and preferably listed are "CLEARMIX", ultrasonic homogenizers, mechanical homogenizers, Manton-Gaulin and pressure type homogenizers, and medium type homogenizers such as sand grinders, Getman mill, diamond fine mills and the like. Further, listed as surface active agents may be the same as those previously described.

Further, colorants (particles) may be subjected to surface modification. The surface modification method is as follows. Colorants are dispersed into a solvent, and surface modifiers are added to the resulting dispersion. Subsequently the resulting mixture is heated so as to undergo reaction. After completing said reaction, colorants are collected by filtration and repeatedly washed with the same solvent. Subsequently, the washed colorants are dried to obtain the colorants (pigments) which are treated with said surface modifiers.

The salting-out/fusion process is accomplished as follows. Salting-out agents, containing alkaline metal salts and/or alkaline earth metal salts and the like, are added to water comprising resin particles as well as colorant particles as the coagulant at a concentration of higher than critical aggregation concentration. Subsequently, the resulting aggregation is heated above the glass transition point of said resin particles so that fusion is carried out while simultaneously conducting salting-out. During this process, organic solvents, which are infinitely soluble in water, may be added.

Herein, listed as alkali metals and alkali earth metals, employed as salting-out agents, are, as alkali metals, lithium, potassium, sodium, and the like, and as alkali earth metals, magnesium, calcium, strontium, barium, and the like. Further, listed as those forming salts are chlorides, bromides, iodides, carbonates, sulfates, and the like.

Further, listed as said organic solvents, which are infinitely soluble in water, are alcohols such as methanol, ethanol, 1-propanol, 2-propanol, ethylene glycol, glycerin, acetone, and the like. Of these, preferred are methanol, ethanol, 1-propanol, and 2-propanol which are alcohols having not more than 3 carbon atoms.

In the salting-out/fusion process, it is preferable that hold-over time after the addition of salting-out agents is as short as possible. Namely it is preferable that after the addition of salting-out agents, dispersion containing resin particles and colorant particles is heated as soon as possible and heated to a temperature higher than the glass transition point of said resin particles.

The reason for this is not well understood. However, problems occur in which the aggregation state of particles varies depending on the hold-over time after salting out so that the particle diameter distribution becomes unstable and surface properties of fused toner particles fluctuate.

Time before initiating heating (hold-over time) is commonly not more than 30 minutes, and is preferably not more than 10 minutes.

Temperatures, at which salting-out agents are added, are not particularly limited, and are preferably no higher than the glass transition temperature of resin particles.

Further, it is required that in the salting-out/fusion process, the temperature is quickly increased by heating. The rate of temperature increase is preferably no less than 1° C./minute. The maximum rate of temperature increase is not particularly limited. However, from the viewpoint of minimizing the formation of coarse grains due to rapid salting-out/fusion, said rate is preferably not more than 15° C./minute.

Further, after the dispersion containing resin particles and colorant particles is heated to a higher temperature than said glass transition point, it is important to continue the salting-out/fusion by maintaining the temperature of said dispersion for a specified period of time. By so doing, it is possible to effectively proceed with the growth of toner particles (aggregation of resin particles as well as colorant particles) and fusion (disappearance of the interface between particles. As a result, it is possible to enhance the durability of the finally obtained toner.

Further, after terminating the growth of coalesced particles, fusion by heating may be continued.

(Filtration and Washing)

In said filtration and washing process, carried out is filtration in which toner particles are collected from the toner particle dispersion obtained by the process previously described, and adhered materials such as surface active agents, salting-out agents, and the like, are removed from the collected toner particles (a caked aggregation).

Herein, the filtration methods are not particularly limited, and include a centrifugal separation method, a vacuum filtration method which is carried out employing Buchner's funnel and the like, a filtration method which is carried out employing a filter press, and the like.

(Drying Process)

The washed toner particles are dried in this process.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

It is proposed that the moisture content of dried toners is preferably not more than 5 percent by weight, and is more preferably not more than 2 percent by weight.

Further, when dried toner particles are aggregated due to weak attractive forces among particles, aggregates may be subjected to pulverization treatment. Herein, employed as pulverization devices maybe mechanical pulverization devices such as a jet mill, a HENSCHEL MIXER, a coffee mill, a food processor, and the like.

(Addition Process of External Additives)

This process is one in which external additives are added to dried toner particles.

Listed as devices which are employed for the addition of external additives, may be various types of mixing devices known in the art, such as tubular mixers, HENSCHEL MIXERs, Nauter mixers, V-type mixers, and the like.

The proportion of number of toner particles having a diameter of at most 0.7×(Dp50) Proportion of is 10 percent or less. It is preferable to control the temperature during the salting-out/fusion narrow for obtaining toner particles satisfying such condition. More in concrete temperature is elevated as fast as possible. The time for elevation is preferably 30 minutes or less, more preferably 10 minutes or less, and the elevation rate is preferably 1 to 15° C./minutes.

Besides colorants and releasing agents, materials, which provide various functions as toner materials may be incorporated into the toner. Specifically, charge control agents are cited. Said agents may be added employing various methods such as one in which during the salting-out/fusion stage, said charge control agents are simultaneously added to resin particles as well as colorant particles so as to be incorporated into the toner, another is one in which said charge control agents are added to resin particles, and the like.

In the same manner, it is possible to employ various charge control agents, which can be dispersed in water. Specifically listed are nigrosine based dyes, metal salts of naphthenic acid or higher fatty acids, alkoxyamines, quaternary ammonium salts, azo based metal complexes, salicylic acid metal salts or metal complexes thereof.

The water content of toner is 0.1-2.0 weight %. The water content of toner can be adjusted by the following methods.

The concrete toner water content adjusting method;

1) Increase the quantity of run-off water compositions of toner, especially its binder resin.
2) Lower the water content of the external additive agent of toner. It may be effective for it to make a degree of hydrophobilization of the external additive agent high as described later. It is desirable to use one having the degree of hydrophobilization of the external additive agent of 60 or more.
3) To increase an amount of a releasing agent which exists on the surface may be an effective method. In order to do so, it may be especially suitable to use polyolefin based wax. In order to increase an amount of polyolefin existing on the surface, there is a method to make it bleed out from the surface of toner by providing frictional heat at the time of crashing by the use of a mechanical grinder.
4) Adjust an amount of carboxylic acid on the surface of toner.

A range of a water content

A water content of toner is preferably 0.1 to 2.0 mass % under 30° C. 80% RH environment, more preferably 0.2 to 1.8 mass %.

Measuring Method of Water Content of Toner

After putting toner into the Fischer sample bottle, It is left while opening the bottle under 30° C. and 80% RH ambient for 72 hours. And having left it, the bottle is enclosed and the water content is measures by a Karl Fischer technique. A measuring instrument is a Hiranuma type automatic fine water measurement device AQS-724, and as a measurement condition, a vaporization temperature is set to 110° C., and a vaporization time is set to 25 seconds.

<Developers>

The toner of the present invention may be employed in either a single-component developer or a two-component developer.

Listed as single-component developers are a non-magnetic single-component developer, and a magnetic single-component developer in which magnetic particles having a diameter of 0.1 to 0.5 μm are incorporated into a toner. The toner may be employed in both developers.

Further, said toner is blended with a carrier and employed as a two-component developer. In this case, employed as magnetic particles of the carrier may be conventional materials known in the art, such as metals such as iron, ferrite, magnetite, and the like, alloys of said metals with aluminum, lead and the like. Specifically, ferrite particles are preferred. The volume average particle diameter of said magnetic particles is preferably 15 to 100 μm, and is more preferably 25 to 80 μm.

The volume average particle diameter of said carrier can be generally determined employing a laser diffraction type particle size distribution measurement apparatus "HELOS", produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like.

Figure 3:
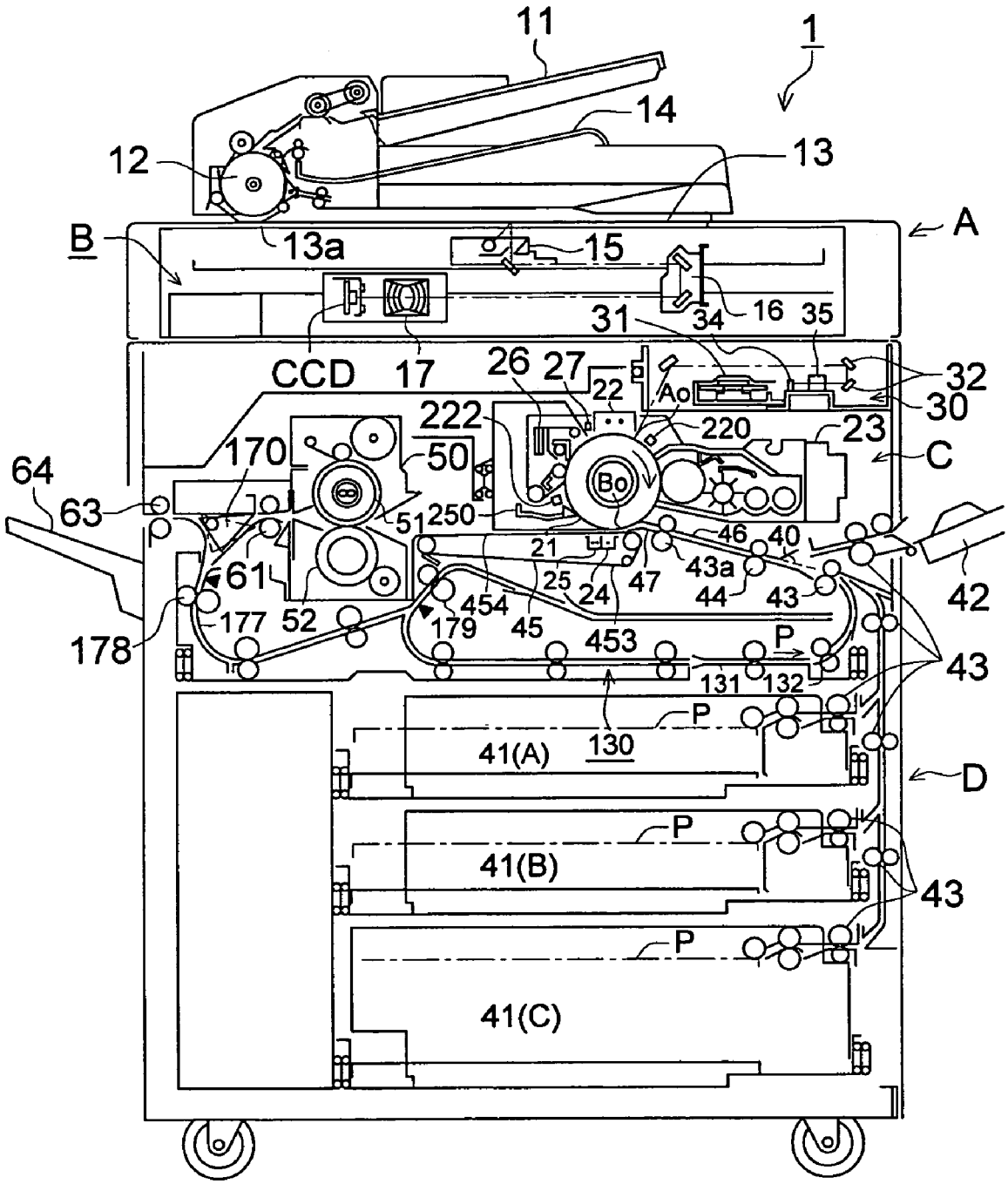
FIG. 3 is a sectional schematic view of an image forming apparatus relating to the invention.

The following describes the image forming apparatus using an organic photoreceptor:

The image forming apparatus 1 shown in FIG. 3 is a digital image forming apparatus. It comprises an image reading section A, an image processing section B, an image forming section C, and a transfer paper conveyance section D as a transfer paper conveyance means.

An automatic document feed device which automatically feeds documents is arranged on the top of the image reading section A. The documents placed on the document platen as conveyed sheet by sheet by means of a document conveying roller 12, and the image is read at the reading position 13*a*. The document having been read is ejected onto a document ejection tray 14 by the document conveying roller 12.

In the meantime, the image of the document placed on the plate glass 13 is read by the reading operation at the speed v by the first mirror unit 15 consisting of an illumination lamp constituting a scanning optical system and a first mirror, and by the movement of the second mirror unit 16 consisting of the second and third mirrors located at the V-shaped position at the speed v/2 in the same direction.

The scanned images are formed on the light receiving surface of an image-capturing device (CCD) as a line sensor through the projection lens 17. The linear optical images formed on the image-capturing device (CCD) are sequentially subjected to photoelectric conversion into electric signals (luminance signals). Then they are subjected to analog-to-digital conversion, and then to such processing as density conversion and filtering in the image processing section B. After that, image data is stored in the memory.

The image forming section C as an image forming unit comprises: a drum-formed photoreceptor 21 as an image carrier; a charging device (charging process) 22 for charging the photoreceptor 21 on the outer periphery, a potential detecting section 220 for detecting the potential on the surface of the charged photoreceptor; a developing section (developing process) 23; a transfer/conveyance belt apparatus 45 as a transfer section (transfer process); a cleaning apparatus (cleaning process) 26 for the photoreceptor 21; and a PCL (pre-charge lamp) 27 as an optical electric charge eliminator (residual potential eliminating process).

These components are arranged in the order of operations. Further, a reflected density detecting section 222 for measuring the reflected density of the patch image developed on the photoreceptor 21 is provided downstream from the developing section 23. An organic photoreceptor of the present invention is used as the photoreceptor 21, and is driven in the clockwise direction as illustrated.

The rotating photoreceptor 21 is electrically charged uniformly by the charging device 22. After that, image exposure is performed based on the image signal called up from the memory of the image processing section B by the exposure optical system as an image exposure section (image exposure process) 30. In the exposure optical system as an image exposure section 30—a writing section—, the optical path is bent by a reflection mirror 32 through a rotating polygon mirror 31, fθ lens 34, and cylindrical lens 35, using the laser diode (not illustrated) as a light emitting source, whereby main scanning is performed. Exposure is carried out at position Ao with reference to the photoreceptor 21, and an electrostatic latent image is formed by the rotation (sub-scanning) of the photoreceptor 21.

In an image forming apparatus according to the present invention, at the time of forming the electrostatic latent image on the photoreceptor, the precondition is that the semiconductor laser or light emitting diode with an oscillation wavelength of 350 to 500 nm is used as the image exposure light source. By using such an image exposure light source, condensing the exposure light dot diameter in the main scanning direction of writing to 10 to 50 μm, and by carrying out digital exposure on the surface of the organic photoreceptor it is possible to obtain an electro-photographic image with a resolution of more than 600 dpi (dpi: dots per inch—number of dots per 2.54 cm) and up to 2500 dpi.

Said exposure dot diameter is the length of the exposure beam (Ld: Length measured at the maximum position) along the main scanning direction of the area in which the intensity of said exposure beam is $1/e^2$ or more times the peak intensity.

The optical beams used can be a scanning optical system using a semiconductor laser or a fixed scanner using LEDs, etc. The light intensity distribution can be Gaussian distribution or Lorentz distribution, and in either case, the area with a light intensity of $1/e^2$ or more than the peak intensity is considered as the exposure dot diameter according to the present invention.

In the present invention, the relationship between the exposure dot diameter (A μm) in the main scanning direction formed on the organic photoreceptor and the developed dot diameter in the main scanning direction (B μm) satisfies the following condition.

$$1.1 \leqq B/A \leqq 1.5 \text{ (However, } 10 \leqq A \leqq 50)$$

Here, and the developed dot diameter in the main scanning direction denotes the dot diameter in the main scanning direction (the length is measured at the maximum position) of the toner image corresponding to one dot formed on the photoreceptor described above. Incidentally, the relationship between the exposure dot diameter (A μm) in the main scanning direction and the developed dot diameter (B μm) in the main scanning direction is preferably $1.2 \leqq B/A \leqq 1.4$ and the range of the exposure dot diameter (A μm) is $10 \leqq A \leqq 20$.

In addition, when fluctuations are present in the measured values of both the exposure dot diameter and the developed dot diameter, 20 dots are measured at random for each other and their average values are taken as the exposure dot diameter and the developed dot diameter according to the present invention.

By satisfying this condition, a high-resolution dot image can be achieved, implying satisfactory fine line reproducibility, and also copying between multiple generations will also become possible. In other words, because the relationship between the developed dot diameter (B μm) and the exposure dot diameter (A μm) satisfies the above condition, it is possible to form images with a high image quality due to averaged dot shaped and with high dot reproducibility. In other words, on an organic photoreceptor for which the upper most surface layer has a contact angle of 90° or more with water and the fluctuations in the contact angle are within ±2.0°, by enlarging said B to 1.1 to 1.5 times said A, not only the reproducibility of one pixel that has been written is made definite, but also it is possible to prevent pixel disturbance during the transfer of one pixel formed on the organic photoreceptor, and to enhance the quality of the dot image obtained finally on the transfer sheet.

Further, although the relationship between the developed dot diameter and the exposure dot diameter in the above specific range can also be changed by controlling the potential distribution within one dot, the electrical charge distribution of the toner, laser power, the photoreceptor potential, and the development conditions, etc., it can be changed by simply controlling the developing condition. That is, in the case of a contact type development, by setting the line speed ratio (Vs/Vp) of a line speed (Vs) of a developing sleeve and a line speed (Vp) of a photoreceptor to be 1.1 to 3.0, more preferably 1.2 to 2.5, the ratio of the exposure dot diameter and the developed dot diameter can be adjusted within a range of the present invention. Because, in order to make the developed dot diameter somewhat larger than the exposure dot diameter, it may be necessary to increase somewhat a supply amount of a developer. Therefore, by making the line speed of a developer conveying member, that is, the line speed of the developing sleeve larger somewhat than the line speed of the photoreceptor, the toner is supplied much to a developing region such that the diameter of a developed dot becomes large. Incidentally, if the ratio (Vs/Vp) exceeds 3.0, the ratio of B/A may exceed 1.5.

By making the relationship between the developed dot diameter and the exposure dot diameter within the above specific range, it is possible to obtain improvement of the transfer efficiency during transfer and to suppress image aberrations during transfer.

The electrostatic latent image on the photoreceptor 21 is developed and reversed by the developing device 23, and a visible-toner image is formed on the surface of the photoreceptor 21. In the image forming method, it is desirable to use a polymer toner as the developer used in said development device. By combining the use of polymer toner with uniform shape or particle distribution with an organic photoreceptor according to the present invention, it is possible to obtain an electro-photographic image with increased sharpness and good quality.

In the transfer paper conveyance section D, sheet feed units 41(A), 41(B) and 41(C) as a transfer sheet storage device are arranged below the image forming unit, wherein the transfer sheets P having different sizes are stored. A manual sheet feed unit 42 for manual feed of the sheets of paper is provided on the side. The transfer sheets P selected by either of the two are fed along a sheet conveyance path 40 by a guide roller 43, and are temporarily suspended by the sheet feed registration roller 44 for correcting the inclination and deviation of the transfer sheets P. Then these transfer sheets P are again fed and guided by the sheet conveyance path 40, pre-transfer roller 43*a*, paper feed path 46 and entry guide plate 47. The toner image on the photoreceptor 21 is transferred to the transfer sheet P at the transfer position Bo by a transfer electrode 24 and a separator electrode 25, while being carried by the transfer/conveyance belt 454 of the transfer/conveyance belt apparatus 45. The transfer sheet P is separated from the surface of the photoreceptor 21 and is brought to a fixing apparatus 50 as a fixing device by the transfer/conveyance belt apparatus 45.

The fixing apparatus 50 contains a fixing roller 51 and a pressure roller 52. When the transfer sheet P passes between the fixing roller 51 and pressure roller 52, toner is fixed in position by heat and pressure. With the toner image having been fixed thereon, the transfer sheet P is ejected onto the ejection tray 64.

The above description is concerned with the case where an image is formed on one side of the transfer sheet. In the case of duplex copying, the ejection switching member 170 is switched and the transfer sheet guide 177 is opened. The transfer sheet P is fed in the direction of an arrow showed in a broken line.

Further, the transfer sheet P is fed downward by the conveyance device 178 and is switched back by the sheet reversing section 179. With the trailing edge of the transfer sheet P becoming the leading edge the transfer sheet P is conveyed into the sheet feed unit 130 for duplex copying.

The conveyance guide 131 provided on the sheet feed unit 130 for duplex copying is moved in the direction of sheet feed by the transfer sheet P. Then the transfer sheet P is fed again by the sheet feed roller 132 and is led to the sheet conveyance path 40.

As described above, the transfer sheet P is again fed in the direction of the photoreceptor 21, and the toner image is transferred on the reverse side of the transfer sheet P. After the image has been fixed by the fixing section 50, the transfer sheet P is ejected to the ejection tray 64 through a roller pair 63.

The image processing apparatus can be configured in such a way that the components such as the aforementioned photoreceptor, developing device and cleaning device are integrally combined into a process cartridge, and this unit is removably mounted on the apparatus proper. It is also possible to arrange such a configuration that at least one of the charging device, image exposure device, developing device, transfer electrode, separator electrode and cleaning device is supported integrally with the photoreceptor, so as to form a process cartridge that, as a removable single unit, is mounted on the apparatus proper, using a guide device such as a rail of the apparatus proper.

Figure 4:
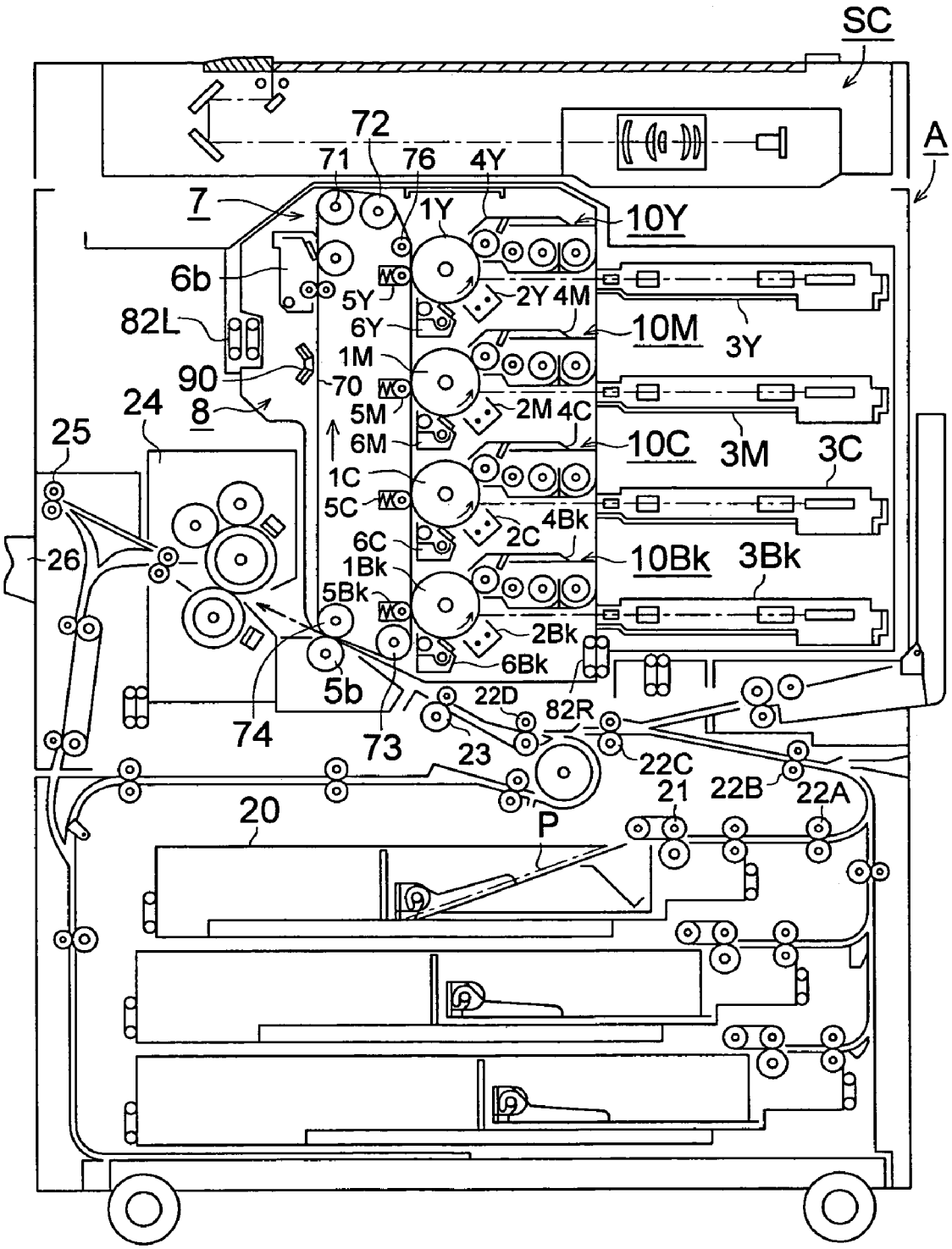
FIG. 4 is a sectional schematic view of a color image forming apparatus relating to the invention.

FIG. 4 is a cross-sectional configuration view diagram of a color image forming apparatus showing a preferred embodiment of the present invention.

This color image forming apparatus is of the so called tandem type color image forming apparatus, and comprises four sets of image forming sections (image forming units) 10Y, 10M, 10C, and 10Bk, an endless belt shaped intermediate image transfer body unit 7, a sheet feeding and transportation device 21, and a fixing device 24. The original document reading apparatus SC is placed on top of the main unit A of the image forming apparatus.

The image forming section 10Y that forms images of yellow color comprises a charging device (charging process) 2Y, an exposing device (exposing process) 3Y, a developing device (developing process) 4Y, a primary transfer roller 5Y as a primary transfer device (primary transfer process), and a cleaning device 6Y all placed around the drum shaped photoreceptor 1Y which acts as the first image supporting body. The image forming section 10M that forms images of magenta color comprises a drum shaped photoreceptor 1M which acts as the first image supporting body, a charging device 2M, an exposing device 3M, a developing device 4M, a primary transfer roller 5M as a primary transfer device, and a cleaning device 6M. The image forming section 10C that forms images of cyan color comprises a drum shaped photoreceptor 1C which acts as the first image supporting body, a charging device 2C, an exposing device 3C, a developing device 4C, a primary transfer roller 5C as a primary transfer device, and a cleaning-device 6C. The image forming section 10Bk that forms images of black color comprises a drum shaped photoreceptor 1Bk which acts as the first image supporting body, a charging device 2Bk, an exposing device 3Bk, a developing device 4Bk, a primary transfer roller 5Bk as a primary transfer device, and a cleaning device 6Bk.

Said four sets of image forming units 10Y, 10M, 10C, and 10Bk are constituted, centering on the photosensitive drums 1Y, 1M, 1C, and 1Bk, by the rotating charging device 2Y, 2M, 2C, and 2Bk, the image exposing device 3Y, 3M, 3C, and 3Bk, the rotating developing device 4Y, 4M, 4C, and 4Bk, and the cleaning device 5Y, 5M, 5C, and 5Bk that clean the photosensitive drums 1Y, 1M, 1C, and 1Bk.

Said image forming units 10Y, 10M, 10C, and 10Bk, all have the same configuration excepting that the color of the toner image formed in each unit is different on the respective photosensitive drums 1Y, 1M, 1C, and 1Bk, and detailed description is given below taking the example of the image forming unit 10Y.

The image forming unit 10Y has, placed around the photosensitive drum 1Y which is the image forming body, a charging device 2Y (hereinafter referred to merely as the charging unit 2Y or the charger 2Y), the exposing device 3Y, the developing device 4Y, and the cleaning device 5Y (hereinafter referred to merely as the cleaning device 5Y or as the cleaning blade 5Y), and forms yellow (Y) colored toner image on the photosensitive drum 1Y. Further, in the present preferred embodiment, at least the photosensitive drum 1Y, the charging device 2Y, the developing device 4Y, and the cleaning device 5Y in this image forming unit 10Y are provided in an integral manner.

The charging device 2Y is a device that applies a uniform electrostatic potential to the photosensitive drum 1Y, and a corona discharge type of charger unit 2Y is being used for the photosensitive drum 1Y in the present preferred embodiment.

The image exposing device 3Y is a device that carries out light exposure, based on the image signal (Yellow), on the photosensitive drum 1Y to which a uniform potential has been applied by the charging device 2Y, and forms the electrostatic latent image corresponding to the yellow color image, and an array of light emitting devices LEDs and imaging elements (product name: selfoc lenses) arranged in the axial direction of the photosensitive drum 1Y or a laser optical system etc., is used as this exposing device 3Y.

The intermediate image transfer body unit 7 in the shape of an endless belt is wound around a plurality of rollers, and has an endless belt shaped intermediate image transfer body 70 which acts as a second image carrying body in the shape of a partially conducting endless belt which is supported in a free to rotate manner.

The images of different colors formed by the image forming units 10Y, 10M, 10C, and 10Bk, are successively transferred on to the rotating endless belt shaped intermediate image transfer body 70 by the primary transfer rollers 5Y, 5M, 5C, and 5Bk acting as the primary image transfer device, thereby forming the synthesized color image. The transfer material P as the transfer material stored inside the sheet feeding cassette 20 (the supporting body that carries the final fixed image: for example, plain paper, transparent sheet, etc.,) is fed from the sheet feeding device 21, pass through a plurality of intermediate rollers 22A, 22B, 22C, and 22D, and the resist roller 23, and is transported to the secondary transfer roller 5*b* which functions as the secondary image transfer device, and the color image is transferred in one operation of secondary image transfer on to the transfer material P. The transfer material P on which the color image has been transferred is subjected to fixing process by the fixing device 24, and is gripped by the sheet discharge rollers 25 and placed above the sheet discharge tray 26 outside the equipment. Here, the transfer supporting body of the toner image formed on the photoreceptor of the intermediate transfer body or of the transfer material, etc. is comprehensively called the transfer media On the other hand, after the color image is transferred to the transfer material P by the secondary transfer roller 5*b* functioning as the secondary transfer device, the endless belt shaped intermediate image transfer body 70 from which the transfer material P has been separated due to different radii of curvature is cleaned by the cleaning device 6*b* to remove all residual toner on it.

During image forming, the primary transfer roller 5Bk is at all times pressing against the photoreceptor 1Bk. Other primary transfer rollers 5Y, 5M, and 5C come into pressure contact respectively with their corresponding photoreceptor 1Y, 1M, and 1C only during color image forming.

The secondary transfer roller 5*b* comes into pressure contact with the endless belt shaped intermediate transfer body 70 only when secondary transfer is to be made by passing the transfer material P through this.

Further, the chassis 8 can be pulled out via the supporting rails 82L and 82R from the body A of the apparatus.

The chassis 8 comprises the image forming sections 10Y, 10M, 10C, and 10Bk, and the endless belt shaped intermediate image transfer body unit 7.

The image forming sections 10Y, 10M, 10C, and 10Bk are arranged in column in the vertical direction. The endless belt shaped intermediate image transfer body unit 7 is placed to the left side in the figure of the photosensitive drums 1Y, 1M, 1C, and 1Bk. The endless belt shaped intermediate image transfer body unit 7 comprises the endless belt shaped intermediate image transfer body 70 that can rotate around the rollers 71, 72, 73, and 74, the primary image transfer rollers 5Y, 5M, 5C, and 5Bk, and the cleaning device 6*b*.

Figure 5:
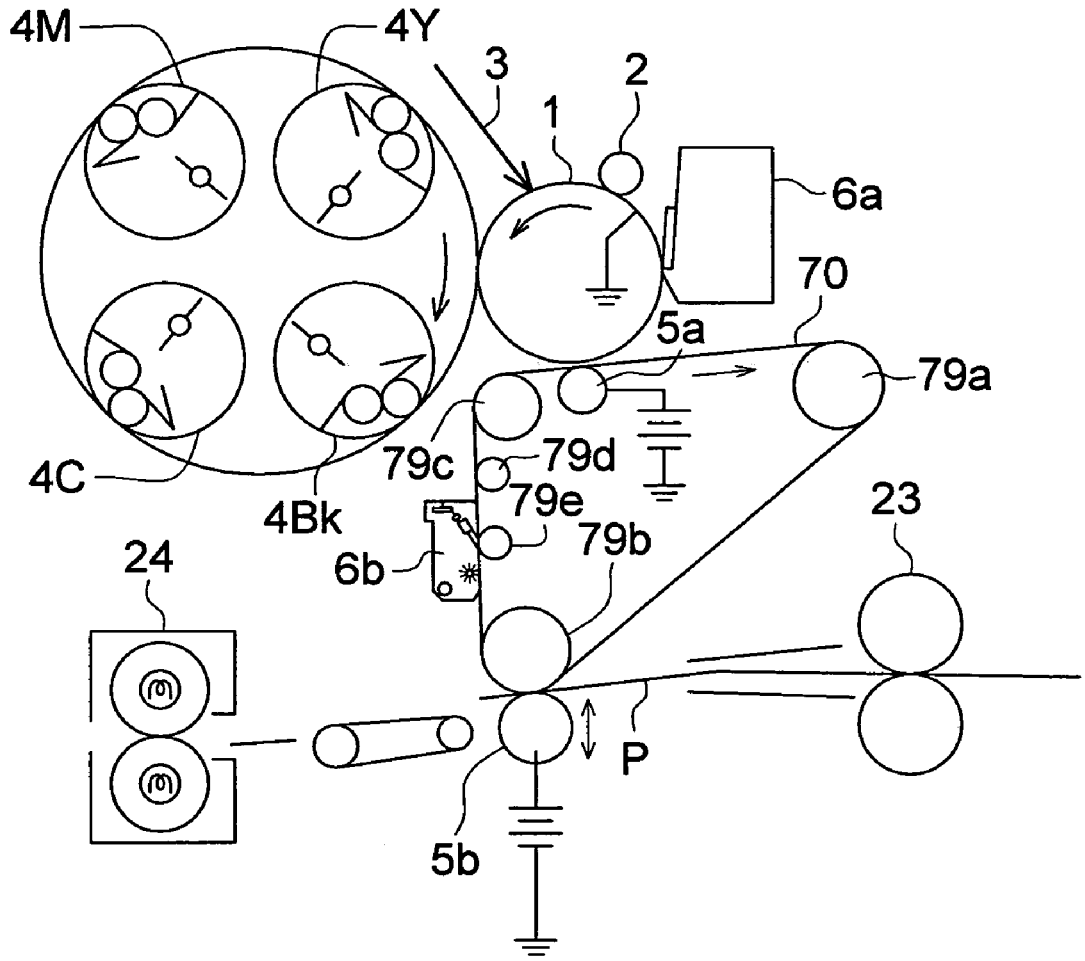
FIG. 5 is a sectional schematic view of a color image forming apparatus employing an organic photoreceptor relating to the invention.

Next, FIG. 5 shows the cross-sectional configuration view diagram of a color image forming apparatus using an organic photoreceptor according to the present invention (a copier or a laser beam printer having at least a charging device, an exposing device, a plurality of developing device, image transfer device, cleaning device, and intermediate image transfer body around the organic photoreceptor). An elastic material with a medium level of electrical resistivity is being used for the belt shaped intermediate image transfer body 70.

In this figure, 1 is a rotating drum type photoreceptor that is used repetitively as the image carrying body, and is driven to rotate with a specific circumferential velocity in the anti-clockwise direction shown by the arrow.

During rotation, the photoreceptor 1 is charged uniformly to a specific polarity and potential by the charging device (charging process) 2, after which it receives from the image exposing device (image exposing process) 3 not shown in the figure image exposure by the scanning exposure light from a laser beam modulated according to the time-serial electrical digital pixel signal of the image information thereby forming the electrostatic latent image corresponding to the yellow (Y) color component (color information) of the target color image.

Next, this electrostatic latent image is developed by the yellow (Y) developing device: developing process (yellow color developer) 4Y using the yellow toner which is the first color. At this time, the second to the fourth developing device (magenta color developer, cyan color developer, and black color developer) 4M, 4C, and 4Bk are each in the operation switched-off state and do not act on the photoreceptor 1, and the yellow toner image of the above first color does not get affected by the above second to fourth developers.

The intermediate image transfer body 70 is wound over the rollers 79*a*, 79*b*, 79*c*, 79*d*, and 79*e* and is driven to rotate in a clockwise direction with the same circumferential speed as the photoreceptor 1.

The yellow toner image of the first color formed and retained on the photoreceptor 1 is, in the process of passing through the nip section between the photoreceptor 1 and the intermediate image transfer body 70, intermediate transferred (primary transferred) successively to the outer peripheral surface of the intermediate image transfer body 70 due to the electric field formed by the primary transfer bias voltage applied from the primary transfer roller 5*a* to the intermediate image transfer body 70.

The surface of the photoreceptor 1 after it has completed the transfer of the first color yellow toner image to the intermediate image transfer body 70 is cleaned by the cleaning apparatus 6*a*.

In the following, in a manner similar to the above, the second color magenta toner image, the third color cyan toner image, and the fourth color black toner image are transferred successively on to the intermediate image transfer body 70 in a superimposing manner, thereby forming the superimposed color toner image corresponding to the desired color image.

The secondary transfer roller 5*b* is placed so that it is supported by bearings parallel to the secondary transfer opposing roller 79*b* and pushes against the intermediate image transfer body 70 from below in a separable condition.

In order to carry out successive overlapping transfer of the toner images of the first to fourth colors from the photoreceptor 1 to the intermediate image transfer body 70, the primary transfer bias voltage applied has a polarity opposite to that of the toner and is applied from the bias power supply. This applied voltage is, for example, in the range of +100V to +2 kV.

During the primary transfer process of transferring the first to the third color toner image from the photoreceptor 1 to the intermediate image transfer body 70, the secondary transfer roller 5*b* and the intermediate image transfer body cleaning device 6*b* can be separated from the intermediate image transfer body 70.

The transfer of the superimposed color toner image transferred on to the belt shaped intermediate image transfer body on to the transfer material P which is the second image supporting body is done when the secondary transfer roller 5*b* is in contact with the belt of the intermediate image transfer body 70, and the transfer material P is fed from the corresponding sheet feeding resist roller 23 via the transfer sheet guide to the contacting nip between the secondary transfer roller 5*b* and the intermediate image transfer body 70 at a specific timing. The secondary transfer bias voltage is applied from the bias power supply to the secondary image transfer roller 5*b*. Because of this secondary transfer bias voltage, the superimposed color toner image is transferred (secondary transfer) from the intermediate image transfer body 70 to the transfer material P which is the second image supporting body. The transfer material P which has received the transfer of the toner image is guided to the fixing device 24 and is heated and fixed there.

The image forming method according to the present invention can be applied in general to all electro-photographic apparatuses such as electro-photographic copiers, laser printers, LED printers, and liquid crystal shutter type printers, and in addition, it is also possible to apply the present invention to a wide range of apparatuses applying electro-photographic technology, such as displays, recorders, light printing equipment, printing screen production, and facsimile equipment.

Although examples are given and this invention is hereafter explained to details, the aspect of this invention is not limited to this. Incidentally, "part" in the following sentences represents "parts by weight".

Manufacture of Photoreceptor 1

The photoreceptor 1 was produced as follows.

The surface of cylinder type aluminum base support was subjected to a cutting process, and a conductive base support of surface roughness Rz=1.5 (μm) was prepared.

<Intermediate Layer>

The following intermediate layer dispersion liquid was diluted twice with the same mixed solvent, and filtered after settling for overnight (filter; NihonPall Ltd. company make RIGIMESH 5 μm filter), whereby the intermediate layer coating solution was produced.

Polyamide resin CM8000 (made by Toray Industries, Inc.) 1 part

Inorganic particles: Titanium oxide (number average first order particle diameter of 35 nm: titanium oxide subjected to a silica alumina process and a methyl hydrogen polysiloxane process) 3 parts Methanol 160 parts The above-mentioned composites were mixed, dispersion was performed for 10 hours by a batch system, using a sand mill as a homogenizer, and whereby intermediate layer dispersion liquid was produced.

On the above-mentioned base support, the above-mentioned coating solution was coated so that it became 1.0 μm of thickness of dried coating.

<Electric Charge Generating Layer (CGL)>

Electric charge occurrence material (CGM): the above CGM-1 24 parts

Polyvinyl butyral resin "Eslek BL-1" (made by Sekisui Chemical Co., Ltd.) 12 parts 2-butanone/cyclohexanone=4/1 (v/v) 300 parts The above-mentioned compositions were mixed and dispersed using the sand mill, thereby a charge generation layer coating solution was prepared. This coating liquid was applied by a dip coating method on the interlayer, thereby an electric charge generating layer of 0.5 μm dry film thickness was formed.

<Charge Transporting Layer 1 (CTL1)>

Electric charge transportation material (the above CTM-4) 225 parts

Polycarbonate (Z300: manufactured by a Mitsubishi Gas Chemical Company INC. company) 300 parts Antioxidant (Irganox1010: made by Ciba-Geigy Japan) 6 parts Dichloromethane 2000 parts Silicone oil (KF-54: made by Shin-Etsu Chemical Co., Ltd. company) 1 Part The above-mentioned compositions were mixed and dissolved, thereby a charge transporting layer coating solution 1 was prepared. This coating solution was coated on the above-mentioned charge generation layer by the immersion coating method, and was subjected to a dry process at 110° C. for 70 minutes, whereby the charge transporting layer of 10.0 μm of dried coating layer thickness was formed.

<Preparation of Polytetrafluoroethylene Resin Particle (PTFE Particles) Dispersion Liquid>

PTFE particles (PTFE particles having a number average first order particle diameters of 0.12 μm and a degree of crystallinity 91.3) were heat-treated for 40 minutes at 250° C.

to make the degree of crystallinity to 82.8, and the following PTFE particle dispersion liquid was prepared using the PTFE particles.

PTFE particles (PT1: number average first order particle diameters of 0.12 μm, and degree of crystallinity of 82.8) 200 parts Toluene 600 parts Fluorine based comb type graft polymer (a product name GF300, manufactured by Toagosei Co., Ltd. Chemistry) 15 parts After mixing the above-mentioned compositions, the resultant mixture was dispersed with a sand grinder (manufactured by Amex company) using glass bead, and whereby PTFE particle dispersion liquid was prepared.

<Charge Transporting Layer 2 (CTL2)>

PTFE particle dispersion liquid 815 parts

Electric charge transportation materials (the above CTM4) 150 parts

Siloxane-modified polycarbonate resin (PC-1) 150 parts

Polycarbonate (Z300: manufactured by a Mitsubishi Gas Chemical Company INC. company) 150 parts Antioxidant (Irganox1010: made by Ciba-Geigy Japan) 12 parts THF: Tetrahydrofuran 2800 parts Silicone oil (KF-54: made by a Shin-Etsu Chemical Co., Ltd. company) 4 Parts The above-mentioned compositions were mixed and dissolved, thereby a charge transporting layer 2 coating solution was prepared. This coating solution was coated on the above-mentioned charge transporting layer by a circular slide hopper type coating apparatus, and was subjected to a dry process at 110° C. for 70 minutes, whereby the charge transporting layer of 2.0 μm of dried coating layer thickness was formed.

Production of Photoreceptors 2-12

In production of the photoreceptor 1, photoreceptors 2-12 were produced in the similar way with the photoreceptor 1 except that a kind and added amount of fluorine based resin particles of the charge transporting layer 2 (CTL2) were changed as shown in Table 1.

As a result of measurement of a contact angle and a dispersion of contact angle for Photoreceptors 1 to 11 (the dispersion of contact angle is indicated with an absolute value), results shown in Table 1 were obtained.

In Table 1, PTFE, and H show the following fluorine based resin fine particles.

PTFE: Polyethylene-terephthalate-resin particles

H: Copolymerization resin particles of ethylene trifluoride-ethylene tetrafluoride In the column of coating apparatus, *1 represents a ring-shaped slide hopper type coating apparatus, and *2 represents an immersion coating apparatus.

Moreover, contact angle and dispersion in contact angle in Table 1 were measured by the above mentioned method.

Toner and the developer using the toner which are used for the present invention were produced.

Next, toner was produced as described below.

* Production of Toner 1Bk

After melting and kneading 100 parts of styrene-acryl resin composed of mass ratios of styrene:butyl acrylate:butyl methacrylate=80:10:10, 10 parts of carbon black, and 5 parts of low-molecular-weight polypropylene (number average molecular weight=3500), fine grinding was performed for the mixture with a mechanical grinder and a careful classification was carried out for them with an air classification machine, coloring particles having a 50% volume particle diameter (Dv50) of 8.1 μm were obtained. For this coloring particles, 1.2 mass % of hydrophobic silica (a degree of hydrophobilization=80/a number average primary particle diameter=12 nm) were added to obtain toner. This toner is referred as "Toner 1Bk".

* Production of Toner 2Bk

After melting and kneading 100 parts of styrene-acryl resin composed of mass ratios of styrene:butyl acrylate:butyl methacrylate:acrylic acid=75:18:5:2, 10 parts of carbon black, and 5 parts of low-molecular-weight polypropylene (number average molecular weight=3500), fine grinding was performed for the mixture with a mechanical grinder and a careful classification was carried out for them with an air classification machine, coloring particles having a 50% volume particle diameter (Dv50) of 8.1 μm were obtained. For this coloring particles, 1.2 mass % of hydrophobic silica (a degree of hydrophobilization=80/a number average primary particle diameter=12 nm) were added to obtain toner. This toner is referred as "Toner 2Bk".

* Production of Toner 3Bk

After melting and kneading 100 parts of styrene-acryl resin composed of mass ratios of styrene:butyl acrylate:meth-

TABLE 1

| | | | | Charge transporting layer 2 | | | | | | |
|---|---|---|---|---|---|---|---|---|---|---|
| Photoreceptor No. | Charge generating material of charge generating layer | Charge transporting layer 1 and charge transporting layer 2 | Layer thickness of charge transporting layer 1 (μm) | Kind of fluorine based resin fine particles | Number average primary order particle diameter (μm) | Degree of crystallinity (%) | Added amount | Coating apparatus | Contact angle (°) | Dispersion of contact angle (\|°\|) |
| 1 | CGM-1 | CTM-4 | 10 | PTFE-1 | 0.12 | 82.2 | 200 | *1 | 112 | 1.4 |
| 2 | CGM-1 | CTM-1 | 10 | PTFE-2 | 0.03 | 73.4 | 200 | *1 | 115 | 0.8 |
| 3 | CGM-2 | CTM-2 | 10 | PTFE-3 | 0.19 | 86.2 | 200 | *1 | 108 | 1.8 |
| 4 | CGM-1 | CTM-4 | 10 | PTFE-4 | 0.01 | 74.6 | 200 | *1 | 95 | 2.2 |
| 5 | CGM-1 | CTM-4 | 10 | PTFE-5 | 0.22 | 86.4 | 200 | *1 | 98 | 2.3 |
| 6 | CGM-3 | CTM-3 | 14 | PTFE-6 | 0.12 | 89.1 | 200 | *1 | 107 | 1.6 |
| 7 | CGM-4 | CTM-5 | 8 | PTFE-1 | 0.12 | 82.2 | 200 | *1 | 112 | 1.4 |
| 8 | CGM-1 | CTM-4 | 10 | PTFE-1 | 0.12 | 82.2 | 100 | *1 | 92 | 1.9 |
| 9 | CGM-1 | CTM-4 | 10 | PTFE-1 | 0.12 | 82.2 | 50 | *1 | 88 | 2.4 |
| 10 | CGM-1 | CTM-4 | 10 | PTFE-1 | 0.12 | 82.2 | 300 | *1 | 118 | 1.2 |
| 11 | CGM-1 | CTM-4 | 10 | PTFE-1 | 0.12 | 82.2 | 400 | *1 | 128 | 1.0 |

acrylic acid=70:20:10, 10 parts of carbon black, and 4 parts of low-molecular-weight polypropylene (number average molecular weight=3500), fine grinding was performed for the mixture with a mechanical grinder and a careful classification was carried out for them with an air classification machine, coloring particles having a 50% volume particle diameter (Dv50) of 4.8 μm were obtained. For this coloring particles, 1.2 mass % of hydrophobic silica (a degree of hydrophobilization=75/a number average primary particle diameter=12 nm) were added to obtain toner. This toner is referred as "Toner 3Bk".

* Production of Toner 4Bk, Toner 4Y, Toner 4M, Toner 4C

Sodium n-dodecylsulfate of 0.90 kg and 10.0 L of pure water were put in a vessel and dissolved while being stirred. Then, this solution was gradually added with 1.20 kg of Regal 330R (carbon black manufactured by Cabot Corp.) while stirring, then this solution was continuously dispersed by the use of a sand grinder (a medium type homogenizer) for successive 20 hours. As a result of measuring the particle size of the above-mentioned dispersion liquid by using an electrophoresis light-scattering photometer ELS-800 by an OTSUKA ELECTRONICS CO., LTD. company, it was 112 nm in weight average diameter. Moreover, the solid content concentration of the above-mentioned dispersion liquid measured with the weighing method by standing desiccation was 16.6 mass %. This dispersion liquid was referred as "Colorant Dispersion Liquid 1."

0.055 kg of sodium dodecylbenzenesulfonate was mixed to ion-exchanged water of 4.0 L, and the mixture was stirred and dissolved under room temperature, whereby an anionic surface active agent solution A was obtained.

0.014 kg of Nonyl phenyl alkyl ether was mixed to ion-exchanged water of 4.0 L, and the mixture was stirred and dissolved under room temperature, whereby a nonion surfactant solution A was obtained.

223.8 g of potassium persulfate was mixed to ion-exchanged water of 4.0 L, and the mixture was stirred and dissolved under room temperature, whereby an initiator solution A was obtained.

3.41 kg of polypropylene emulsion having a number average molecular weight (Mn) of 3500, the anionic surface active agent solution A, and the nonion surfactant solution A were put into a reaction chamber of 100 L which was attached with a temperature sensor, a cooling tube, and a nitrogen introduction device, and stirring was started for it. The, 44.0 L of ion-exchanged water were added.

Heating was started and the whole amount of "initiator solution A" was added when the solution temperature reached 70° C. Thereafter, 14.3 kg of styrene, 2.88 kg of n-butyl acrylate, 0.8 kg of methacrylic acid and 548 g of t-dodecyl metcaptan were added while the temperature was controlled at 75° C.±1° C.

Further, the solution temperature was raised to 80° C.±1° C., and stirred with heating for 6 hours. Then, the solution temperature was cooled down to not higher than 40° C. and stirring was stopped, followed by filtration through Pole Filter resulting in preparation of "Latex A1".

Herein, resin particles in Latex A1 had a glass transition temperature of 59° C., a softening point of 116° C., a weight average molecular weight of 13,400 as a molecular weight distribution, and a weight average particle diameter of 125 nm.

Potassium persulfate of 200.7 g was mixed to ion-exchanged water of 12.0 L, and stirring-under room temperature and dissolving was carried out. This solution was referred as an initiator solution B.

The nonion surfactant solution A was put into a reaction chamber of 100 L which was attached with a temperature sensor, a cooling tube, a nitrogen introduction device, and Kushigata baffle plate and stirring was started for it. The, 44.0 L of ion-exchanged water were added.

Heating was started and "initiator solution B" was added when the solution temperature reached 70° C. At this time, a solution in which 11.0 kg of styrene, 4.00 kg of n-butyl acrylate, 1.04 kg of methacrylic acid and 9.02 g of t-dodecyl mercaptan were mixed in advance, was added.

Thereafter, heating and stirring were performed for 6 hours while controlling the solution temperature at 72° C.±2° C. Further, the solution temperature was raised to 80° C.±2° C., and stirred with heating for 12 hours.

Then, the solution temperature was cooled down to not higher than 40° C. and stirring was stopped, followed by filtration through Pole Filter resulting in preparation of "Latex B1".

Herein, resin particles in Latex B1 had a glass transition temperature of 58° C., a softening point of 132° C., a weight average molecular weight of 245,000 as a molecular weight distribution and a weight average particle diameter of 110 nm.

Sodium chloride of 5.36 kg as a salting agent and ion-exchanged water of 20.0 L were put in, stirred and dissolved, whereby a sodium chloride solution A was obtained.

Latex A1 of 20.0 kg, Latex B1 of 5.2 kg, 0.4 kg of colorant dispersion 1 and 20.0 kg of ion-exchanged water were put and stirred in a 100 L SUS reaction vessel (agitating blades are anchor wings), equipped with a thermosensor, a cooling tube, a nitrogen gas introducing device and a Kushigata baffle plate. Subsequently, it was heated to 35° C. and sodium chloride solution A was added. Then, after leaving it alone for 5 minutes, temperature rising was started and the liquid temperature was raised to 85° C. in 5 minutes (heating rate=10° C./minutes). At the liquid temperature of 85° C.±2° C., heating and stirring was carried out for 6 hours, and salting-out/fusion were made. Thereafter, the solution was cooled down to not higher than 40° C. and stirring was stopped. It was filtered by a filter having a pore size of 45 micrometers and let this filtrate was made as an association liquid. Then, non-spherical particles in a wet cake shape were obtained as a filtrate from the association solution by the use of a centrifuge. Thereafter the products were washed with ion-exchanged water.

Coloring particles in the shape of a wet cake for which washing was completed in the above were dried by 40° C. warm air, and whereby coloring particles were obtained. Furthermore, careful classification was carried out with an air classification machine, and whereby coloring particles having a 50% volume particle size (Dv50) of 4.2 micrometers were obtained. Furthermore, 1.0 mass % of hydrophobic silica (a degree of hydrophobilization=70, a number average primary order diameter=12 nm) were added to this coloring particle, and whereby "toner 4Bk" was obtained.

In production of toner 4Bk, "Toner 4Y" was obtained in the similar way with except that 8 parts of C.I. pigment yellow 185 was used instead of 10 parts of carbon black.

In production of toner 4Bk, "Toner 4M" was obtained in the similar way with except that 8 parts of C.I. pigment red 122 was used instead of 10 parts of carbon black.

In production of toner 4Bk, "Toner 4C" was obtained in the similar way with except that 5 parts of C.I. pigment blue 15:3 was used instead of 10 parts of carbon black.

The measurement results of the saturation water content (mass %) of the above-mentioned toners under 30° C., 80 RH % ambient are shown in a table 2.

Production of Developer

Each of above toners, that is, Toners 1Bk to Toner 4C (total 7 kids of toner) were mixed with ferrite carriers which were covered with silicone resin and had 50% volume particle diameter (Dv50) of 45μm, whereby developer having a toner concentration of 6% was prepared respectively and used for evaluation. These developers are referred as Developer 1Bk to Developer 4C corresponding to toner respectively.

The measurement of the volume average particle diameter (D4) of carriers can be performed typically by a laser diffraction type particle size distribution measuring apparatus HELOS, manufactured by Sympatec Co., Ltd., having a wet type dispersion device.

Reproducibility of a Toner Image on a Photoreceptor

On the photoreceptor, the reproducibility of dots constituting a picture image was evaluated by viewing with a 100-time magnifying glass.

A: The size of a picture image dot was independently respectively reproduced in less than ±30% of the exposure light spot area (excellent).

B: The size of a picture image dot was independently respectively reproduced with increase or decrease of 30 to 60% of the exposure light spot area (a level for actual use).

D: The size of a picture image dot was reproduced with increase or decrease more than 60% of the exposure light spot area and a dot image was partially lost or connected to another do (a level to be problem for an actual use).

Reproducibility of a Toner Image on a Transfer Sheet

A: There was dramatically few toner scattering and a dot picture image is reproduced clearly (excellent).

B: There was toner scattering slightly, however, a dot picture image is reproduced clearly (actual use was permissible).

D: There was much toner scattering, and the shape of a dot image has collapsed (practical use was impossible)

Sharpness

A half tone image was printed on 20,000 sheets and evaluated.

TABLE 2

| Toner No. | Toner producing method example No. | Water amount (mass %) | 50% volume particle diameter (Dv50) (μm) | 50% number particle diameter (Dp50) (μm) | Dv50/Dp50 | Cumulative 75% volume particle diameter (Dv70) (μm) | Cumulative 75% number particle diameter (Dv70) (μm) | Dv75/Dp75 | Number % of particles of 0.7 × Dp50 or less |
|---|---|---|---|---|---|---|---|---|---|
| 1Bk | 1 | 0.2 | 3.8 | 3.6 | 1.05 | 3.4 | 3.2 | 1.06 | 6.5 |
| 2Bk | 2 | 1 | 8.1 | 7.2 | 1.12 | 7.8 | 6.9 | 1.13 | 7.9 |
| 3Bk | 3 | 1.8 | 5.8 | 5.6 | 1.03 | 5.4 | 5.1 | 1.06 | 7.1 |
| 4Bk | 4 | 1.3 | 4.2 | 3.9 | 1.07 | 3.8 | 3.5 | 1.09 | 5.8 |
| 4Y | 4 | 1.4 | 4.8 | 4.6 | 1.05 | 4.2 | 3.9 | 1.08 | 6.9 |
| 4M | 4 | 1.5 | 4.3 | 4.2 | 1.03 | 4 | 3.8 | 1.06 | 5.9 |
| 4C | 4 | 1.3 | 4.9 | 4.7 | 1.05 | 4.5 | 4.2 | 1.08 | 6.8 |

Toner, photoreceptor, exposure light wavelength, exposure light dot diameter (A), development dot diameter (B), and the value of A/B were combined as shown in Table 3 (Combination No. 1 to No. 17), were used for printing 100,000 sheets under a NN condition (23° C. and 50 RH %) and under a HH condition (30° C. and 80 RH %) by the use of a digital process copying machine Konica7050 by Konica Corp. which had the structure of FIG. 3 basically, and evaluated as follows.

A wavelength changeable laser generator was mounted on the above-mentioned digital process copying machine Konica7050 to obtain the required exposure light wavelength, the diameter of an exposure light dot was adjusted by a lens system, B, i.e., A/B, was controlled by a linear velocity ratio of a photoreceptor and a developing sleeve, and the length of a toner image on a photoreceptor (diameter of a dot image) was measured with the microscope.

Further, for the combinations of 1 to 17, an isolation dot with respective exposure light dot diameters was written successively by spacing on dot. After developing, the reproducibility of a toner image on the surface of a photoreceptor and the reproducibility of a toner image on a transfer sheet was observed by an optical microscope and a microdensitometer. The evaluations after initial copy were classified into the following ranks.

A: A halftone picture image of each dpi is reproduced clearly (each dot becoming independent) up to 600 dpi-2400 dpi (high quality image characteristics is dramatically excellent).

B: A halftone picture image of each dpi is reproduced clearly (each dot becoming independent) up to 600 dpi-1200 dpi, however, the clearness of a halftone picture image of 2400 dpi is insufficient (high quality image characteristics is good).

C: A halftone picture image of 600 dpi is reproduced clearly, however, the clearness of a halftone picture image of 1200 dpi to 2400 dpi is insufficient (high quality image characteristics is slightly insufficient).

D: The clearness (independency of each dot) of a halftone picture image of 600 dpi is insufficient (high quality image characteristics is quite insufficient).

The process condition for the above color printer as follows:

Charger: Scorotron electrode

Exposure light: Semiconductor laser

Development: Black toner of 1Bk-4Bk shown in Table 3, a reversal development method Cleaning: Cleaning blade Fixing: Heat fixing The evaluation results are indicted in Table 3.

TABLE 3

| Combination No. | Photoreceptor No. | Developer No. | Exposure light wavelength (nm) | A (μm) | B/A | B (μm) | Image evaluation: NN(23° C., 50RH %) Reproducibility of toner image on photoreceptor | NN Reproducibility of toner image on transfer sheet | NN Sharpness | HH(30° C., 80RH %) Reproducibility of toner image on photoreceptor | HH Reproducibility of toner image on transfer sheet | HH Sharpness | Remarks |
|---|---|---|---|---|---|---|---|---|---|---|---|---|---|
| 1 | 1 | 1Bk | 457 | 24 | 1.18 | 28 | A | A | A | A | A | A | Inv. |
| 2 | 1 | 1Bk | 410 | 12 | 1.07 | 13 | B | D | D | D | D | D | Comp. |
| 3 | 2 | 2Bk | 530 | 30 | 1.38 | 41 | A | A | A | A | A | A | Inv. |
| 4 | 3 | 2Bk | 457 | 24 | 1.17 | 28 | A | A | A | A | A | A | Inv. |
| 5 | 2 | 3Bk | 530 | 30 | 1.38 | 41 | A | A | A | A | A | A | Inv. |
| 6 | 3 | 4Bk | 457 | 24 | 1.18 | 28 | A | A | A | A | A | A | Inv. |
| 7 | 1 | 1Bk | 410 | 12 | 1.25 | 15 | A | A | A | A | A | A | Inv. |
| 8 | 1 | 1Bk | 410 | 24 | 1.45 | 35 | A | A | A | A | A | A | Inv. |
| 9 | 1 | 1Bk | 410 | 24 | 1.58 | 38 | B | D | D | D | D | D | Comp. |
| 10 | 4 | 1Bk | 457 | 24 | 1.18 | 28 | A | B | B | B | B | B | Inv. |
| 11 | 5 | 1Bk | 457 | 24 | 1.18 | 28 | A | B | B | B | B | B | Inv. |
| 12 | 6 | 1Bk | 457 | 24 | 1.18 | 28 | A | A | A | A | A | A | Inv. |
| 13 | 7 | 1Bk | 457 | 24 | 1.18 | 28 | A | A | A | A | A | A | Inv. |
| 14 | 8 | 1Bk | 457 | 24 | 1.18 | 28 | A | B | B | B | B | B | Inv. |
| 15 | 9 | 1Bk | 457 | 24 | 1.18 | 28 | A | B | B | A | B | B | Inv. |
| 16 | 10 | 1Bk | 457 | 24 | 1.18 | 28 | A | A | A | A | A | A | Inv. |
| 17 | 11 | 1Bk | 457 | 24 | 1.18 | 28 | A | A | A | A | A | A | Inv. |

As can be seen from Table 3, in the combination (Combination No. 1, 3 to 8, 10 to 17) having B/A being within a range of 1.1 to 1.5, the reproducibility of a toner image on a photoreceptor, the reproducibility of a toner image on a transfer sheet and the sharpness indicates good results under the NN condition and the HH condition.

<<Evaluation 2>>

Toner and photoreceptor were combined (Combination No. 18), and were used for printing 100,000 sheets under a HH condition (30° C. and 80 RH %) and a condition shown in Table 4 by the use of the modified machine of a color printer magicolor2300 (made by Konica Minolta Business Technologies), which had the structure of FIG. 5 basically and by the use of a short wavelength laser light source as an image exposing light source, and a color image was evaluated in terms of color reproducibility in addition to above evaluation items.

Color Reproducibility

The color of a solid image portion of secondary colors (red, blue, and green) in each toner of Y, M, C of an image on the first sheet and the $100^{th}$ sheet was measure by the use of "MacbethColor-Eye7000", and a color difference of each solid image on the first sheet and the $100^{th}$ sheet was calculated with a CMC(2:1) color difference formula.

A: The color difference is 3 or less (excellent).

D: The color difference is not less that 3 (practical use is not allowed)

As can be seen from Table 4, an electrophotography picture image produced on the condition of B/A of 1.18 by the use of Photoreceptor No. 1 of the present invention indicates good results for the reproducibility of a toner image on a photoreceptor, the reproducibility of a toner image on a transfer sheet, the sharpness indicates and the color reproducibility.

<<Evaluation 3>>

Toner and photoreceptor were combined (Combination No. 19) as shown in Table 5, and were used by the use of modified machine of a full color compound machine 8050 (made by Konica Minolta Business Technologies) which had the structure of FIG. 4 basically and by the use of a short wavelength laser light source as an image exposing light source with the condition shown in Table 5, and a color image was evaluated. The evaluation was conducted with a similar manner in Evaluation 2.

Evaluation Condition

Line speed of Photoreceptor: 220 mm/sec

TABLE 4

| Combination No. | Toner No. | Photoreceptor No. | Exposure light wavelength (nm) | A (μm) All of Y, M, C, Bk | B/A | B (μm) All of Y, M, C, Bk | Image evaluation: Reproducibility of toner image on photoreceptor | Reproducibility of toner image on transfer sheet | Sharpness | Color reproducibility |
|---|---|---|---|---|---|---|---|---|---|---|
| 18 | 4Bk-4C | 1 | 457 | 24 | 1.18 | 28 | A | A | A | A |

TABLE 5

| Combination No. | Toner No. | Photoreceptor No. | Exposure light wavelength (nm) All of Y, M, C, Bk | A (μm) | B/A | B (μm) | Image evaluation: Reproducibility of toner image on photo-receptor | Reproducibility of toner image on transfer sheet | Sharpness | Color reproducibility |
|---|---|---|---|---|---|---|---|---|---|---|
| 19 | 4Bk-4C | 1 | 457 | 24 | 1.18 | 28 | A | A | A | A |

As can be seen from Table 5, an electrophotography picture image produced on the condition of B/A of 1.18 by the use of Photoreceptor No. 1 of the present invention indicates good results for the reproducibility of a toner image on a photoreceptor, the reproducibility of a toner image on a transfer sheet, the sharpness indicates and the color reproducibility.

<<Evaluation 4>>

Evaluation 4 was conducted with the similar manner in Evaluation 2 with exception that the semiconductor laser of the light exposure device was changed to a light emitting diode (oscillation wavelength: 380 nm). Even if the light emitting diode was used as the light exposure device, the evaluation result was as same as Evaluation 2.

By using the image forming method and the image forming apparatus according to the present invention, which is an image forming method using a short wavelength laser, it is possible to form high-density dot images, and also to form high-image quality electro-photographic images with good toner transferability and with low toner splashing, etc. In addition, even in color image formation, it is possible to prepare color images with good dot reproducibility, sharpness, and superior color reproduction. Especially, the reproducibility for too many copies under the HH condition (30° C., 80 RH %).

What is claimed is:

1. An image forming method, comprising:

charging uniformly a surface of an organic photoreceptor while rotating the organic photoreceptor;

exposing the charged surface of the photoreceptor with a light beam having a wavelength in the range of 350 nm to 500 nm in a main scanning direction to form a dot-shaped electrostatic latent image on the photoreceptor; and developing the dot-shaped electrostatic latent image with toner to form a dot-shaped toner image on the photoreceptor so as to satisfy the following formulas:

$$1.1 \leqq B/A \leqq 1.5 \text{ and } 10 \leqq A \leqq 50,$$

where A is a length (μm) of an exposed dot of the dot-shaped electrostatic latent image in the main scanning direction, and B is a length (μm) of a toner dot of the dot-shaped toner image in the main scanning direction.

2. The method of claim 1, wherein the following formulas are satisfied:

$$1.2 \leqq B/A \leqq 1.4 \text{ and } 10 \leqq A \leqq 20.$$

3. The method of claim 1, wherein the light beam is emitted by one of a semiconductor laser and a light emitting diode.

4. The method of claim 1, wherein the developing step is conducted by a developing sleeve rotatable to carry toner to a developing region formed between the photoreceptor and the developing sleeve, and wherein when the photoreceptor rotates at a line speed Vp and the developing sleeve rotates at a line speed Vs, a speed ratio (Vs/Vp) is 1.1 to 3.0.

5. The method of claim 4, wherein the speed ratio (Vs/Vp) is 1.2 to 2.5.

6. The method of claim 4, wherein the rotating direction of the developing sleeve is counter to that of the photoreceptor in the developing region.

7. The method of claim 1, wherein the surface of the photoreceptor has a contact angle of 90° or more for water and a variation in the contact angle is not more than ±2.0°.

8. The method of claim 7, wherein the surface of the photoreceptor contains fluorine-containing resin particles.

9. The method of claim 8, wherein the fluorine-containing resin particles have a number average primary particle diameter in the range of 0.02 μm to 0.2 μm.

10. The method of claim 8, wherein the fluorine-containing resin particles have a crystallinity in the range of 40% to 90%.

11. The method of claim 1, wherein the photoreceptor has a charge generating layer and a charge transporting layer provided on the charge generating layer and the thickness of the charge transporting layer is 20 μm or less.

12. The method of claim 1, wherein the toner has a median diameter based on volume in the range of 2 μm to 9 μm.

13. The method of claim 12, wherein the surface of the photoreceptor contains fluorine-containing resin particles having a number average primary particle diameter in the range of 0.02 μm to 0.2 μm, wherein the toner comprises toner particles, ratio (Dv50/Dp50) of the toner particles of 50% volume particle diameter (Dv50) and 50% number particle diameter (Dp50) is 1.0-1.15.

14. The method of claim 13, wherein the following formula is satisfied:

$$1.2 \leqq B/A \leqq 1.4.$$

15. The method of claim 1, wherein when Dp50 represents a 50% number particle diameter of toner particles of the toner, the toner contains toner particles having a particle diameter of 0.7×(Dp50) in an amount of 8 number % or less and has a water content of 0.1 to 2.0 mass % (under 30° C. 80% RH environment).

16. A color image forming method, comprising:

(a) charging uniformly a surface of an organic photoreceptor while rotating the organic photoreceptor;

(b) exposing the charged surface of the photoreceptor with a light beam having a wavelength in the range of 350 nm to 500 nm in a main scanning direction to form a dot-shaped electrostatic latent image on the photoreceptor; and (c) developing the dot-shaped electrostatic latent image with toner to form a dot-shaped toner image on the photoreceptor so as to satisfy the following formulas:

$$1.1 \leqq B/A \leqq 1.5 \text{ and } 10 \leqq A \leqq 50,$$

where A is a length (μm) of an exposed dot of the dot-shaped electrostatic latent image in the main scanning direction, and B is a length (μm) of a toner dot of the dot-shaped toner image in the main scanning direction, (d) transferring the toner image to an intermediate transfer member, (e) conducting the steps of (a) through (d) for each of plural different colors so as to superimpose the plural different color toner images on the intermediate transfer member; and (f) transferring the superimposed different color toner images on a recording material.

17. The method of claim 16, wherein the surface of the photoreceptor contains fluorine-containing resin particles having a number average primary particle diameter in the range of 0.02 μm to 0.2 μm, and wherein the toner has a median diameter based on volume in the range of 2 μm to 9 μm, and the toner comprises toner particles, ratio (Dv50/Dp50) of the toner particles of 50% volume particle diameter (Dv50) and 50% number particle diameter (Dp50) is 1.0-1.15.

18. A color image forming method for use in an image forming apparatus having a plurality of organic photoreceptors each for forming a color toner image, the method comprising:

(a) charging uniformly a surface of an organic photoreceptor while rotating the photoreceptor;

(b) exposing the charged surface of the photoreceptor with a light beam having a wavelength in the range of 350 nm to 500 nm in a main scanning direction to form a dot-shaped electrostatic latent image on the photoreceptor; and (c) developing the dot-shaped electrostatic latent image with toner to form a dot-shaped toner image on the photoreceptor so as to satisfy the following formulas:

$$1.1 \leqq B/A \leqq 1.5 \text{ and } 10 \leqq A \leqq 50,$$

where A is a length (μm) of an exposed dot of the dot-shaped electrostatic latent image in the main scanning direction, and B is a length (μm) of a toner dot of the dot-shaped toner image in the main scanning direction, (d) transferring the toner image onto an intermediate transfer member;

(e) conducting the steps of (a) through (d) for each of plural different colors so as to superimpose the plural different color toner images on the intermediate transfer member.

19. The method of claim 18, wherein the surface of each of the plurality of photoreceptors contains fluorine-containing resin particles having a number average primary particle diameter in the range of 0.02 μm to 0.2 μm, and wherein the toner has a median diameter based on volume in the range of 2 μm to 9 μm, and the toner comprises toner particles, ratio (Dv50/Dp50) of the toner particles of 50% volume particle diameter (Dv50) and 50% number particle diameter (Dp50) is 1.0-1.15.

20. The method of claim 19, wherein the both of exposed dot and the toner dot are formed on each of the plurality of the photoreceptors so as to satisfy the formulas.

* * * * *